US007160172B2

(12) United States Patent
Frost et al.

(10) Patent No.: US 7,160,172 B2
(45) Date of Patent: Jan. 9, 2007

(54) MULTI-STATION DISK FINISHING APPARATUS AND METHOD

(75) Inventors: David Frost, San Jose, CA (US); John McEntee, Boulder Creek, CA (US); Adam Sean Harbison, Los Gatos, CA (US)

(73) Assignee: Xyratex Technology Ltd., Havant Hampshire (GB)

( * ) Notice: Subject to any disclaimer, the term of this patent is extended or adjusted under 35 U.S.C. 154(b) by 0 days.

(21) Appl. No.: 11/303,763

(22) Filed: Dec. 16, 2005

(65) Prior Publication Data

US 2006/0135042 A1 Jun. 22, 2006

Related U.S. Application Data

(60) Provisional application No. 60/701,705, filed on Jul. 22, 2005, provisional application No. 60/637,067, filed on Dec. 17, 2004.

(51) Int. Cl.
*B24B 21/12* (2006.01)

(52) U.S. Cl. ..... 451/5; 451/336; 451/41; 15/77; 15/88.3; 198/733

(58) Field of Classification Search ..... 451/5, 451/41, 336; 15/3.13, 3.16, 77, 88.3, 165.77, 15/165.71, 165.74, 328, 140, 137, 148; 198/733, 198/734; 414/935; 134/902
See application file for complete search history.

(56) References Cited

U.S. PATENT DOCUMENTS 2,603,039 A * 7/1952 Slocum et al. ..... 451/110
2,880,432 A * 4/1959 Schnider et al. ..... 15/3.16
3,481,083 A * 12/1969 David et al. ..... 451/63
4,145,846 A * 3/1979 Howland et al. ..... 451/5
4,262,452 A * 4/1981 Lopez ..... 451/63
4,374,689 A * 2/1983 Smith et al. ..... 156/169
4,535,567 A * 8/1985 Seaborn ..... 451/317
4,964,242 A 10/1990 Ruble et al.
5,018,311 A * 5/1991 Malagrino et al. ..... 451/302
5,088,240 A 2/1992 Ruble et al.
5,099,615 A 3/1992 Ruble et al.
6,588,043 B1 7/2003 Frost et al.

* cited by examiner

*Primary Examiner*—Lee D. Wilson
*Assistant Examiner*—Anthony Ojini
(74) *Attorney, Agent, or Firm*—Innovation Law Group, Ltd.; Jacques M. Dulin, Esq.

(57) ABSTRACT

Multi-disk processing system and method of continuous finishing of memory media disks for digital data storage systems in preparation for magnetic memory coating, comprising four main sub-systems: 1) multiple driven spindles mounted on a chassis, at 3, 6, 9 and 12 o'clock positions; 2) finishing tape head units mounted on a base; 3) a robotic handler for loading and unloading disks onto/off at least one of the spindles; and 4) a programmable system controller that controls the sub-system operations and loading/unloading. The tape head sub-system includes its own programmable controller and sensors for control of the finishing tape advance. The multiple spindles and handler rotate relative to each other. In a preferred embodiment, the spindles are mounted on a rotating turntable that also oscillates. Alternately, the spindles are fixed in position and a rotating handler with multiple grippers for simultaneously loading/unloading disks from all spindles at once is used.

70 Claims, 16 Drawing Sheets

MULTI-STATION DISK FINISHING APPARATUS AND METHOD

CROSS REFERENCE TO RELATED APPLICATIONS

This application is the Regular US Application of prior filed Provisional Applications Ser. No. 60/637,067 filed Dec. 17, 2004 by the same inventors under the title MULTI-STATION DISK TEXTURING APPARATUS AND METHOD, and Ser. No. 60/701,705 filed Jul. 22, 2005 by the same inventors under the title MULTI-STATION DISK TEXTURING APPARATUS AND METHOD II, the priority of both of which is claimed under 35 US Code §§ 119 and 120, and the entire subject matter of which are hereby incorporated by reference.

SPECIFICATION

1. Copyright Notice under 37 CFR §1.71

A portion of the disclosure of this patent document contains material which is subject to copyright protection. The copyright owner, Xyratex Technology, Ltd., Havant, UK, has no objection to the facsimile reproduction by anyone of the issued patent document or the patent disclosure, as it appears in the US Patent and Trademark Office patent file or records, for the purpose of informing themselves of the content and scope of the patent, but otherwise reserves all copyright rights whatsoever.

2. Field

The invention relates to finishing of memory media disks for hard drives and other electronic digital data storage systems, and more particularly equipment and methods for surface finishing, including mechanical and chemo-mechanical or abrasive texturing, burnishing, post-lube buff/wipe, and the like, of disks in preparation for coating with magnetic memory materials, or post-coating treating or polishing. The inventive finishing apparatus comprises a multi-spindle indexing, multi-position, rotating and rocking turntable that is integrated with load/unload robotic handler unit, and paired tape units, e.g., employing fixed or slurry abrasive texturing or non-abrasive tape wipe, cleaning, or burnishing magazines, in a new or retrofit, system for continuous disk processing, as compared to the present single station, one-at-a-time, sequential processor devices. The unique turntable rocking motion is termed "pivoscillation".

3. Background

The hard disk manufacturing industry currently uses single-station, sequential disk texturing devices, such as the Model 1800 Disk Finisher manufactured by Exclusive Design Company, Inc. of San Mateo, Calif. Such single station (single spindle) disk finisher units and methods of operation are disclosed in U.S. Pat. Nos. 4,964,242; 5,088,240; and 5,099,615. The EDC disk finisher units (also called texturing units) are typically used with a robotic handler to mount disks from a cassette on a drive spindle for coarse texturing by means of a first abrasive tape drive head that moves laterally into contact with the disk, followed by a water rinse. The coarse texture step is followed by a second, fine texture operation with a second, finer grit abrasive tape drive head that moves laterally from a second position into contact with the rotating disk, and then a second rinse. The robotic handler removes the textured first disk from the spindle, and sequentially follows by mounting and demounting $2^{nd}$, $3^{rd}$, etc. disks, one at a time. An alternative processing approach employs separate stations for the coarse texturing and the fine texturing, with a robotic handler transferring disks from the first coarse texture station to the second, separate fine texture station, after a rinse step at the first station.

In both approaches, the texturing at each abrasive level takes about 20 seconds, and the rotating disk must come to a complete stop on the spindle for the transfer by the robot handler to be effected. The spindle rotation speed may be different for each grade or level of abrasive fineness. The spindle is typically mounted for slight horizontal oscillation so that the texture pattern on the disk is not a series of concentric circles.

The texturing abrasive tape drive head comprises a mirror image, paired layout of tape paths so that the disk (work piece) is textured on both sides at once in the nip between complementary, spaced load (work) rollers around which the abrasive tape is slowly driven or incremented (intermittently advanced). This maintains fresh abrasive in contact with the disk surface in a "use-once" abrasive strategy. The texturing occurs along the entire radius of a disk, and the radial contact area of the abrasive tape on the disk between the spaced work rollers nip is approximately $1/10^{th}$ inch wide. Each tape is unreeled from a tape supply reel under braking tension, passed over two angular feed compensation and tension monitoring idler rollers, fed to the nip of the load roller, and then over a series of three tension maintaining and monitoring rollers to a direct drive (e.g., DC gear motor-driven) take up reel. Transducers monitor the drive speed as input to the control system.

The tape tension is monitored and the tape feed and take up drive rates are controlled to provide substantially constant work in the nip between the two load rollers. The abrasive can be an aluminum oxide, diamond, or other abrasive, either embedded in a binder and coated onto a flexible Mylar backing tape or applied in the form of a slurry onto a tape made of absorbent material such as felt. In either case, the abrasive cuts microscopic grooves in the surfaces of the disk, and the load rollers are typically oscillated along a disk radius to provide a "cross-hatching" (intersecting) pattern of grooves, on the order of 12 micro-inches in width and depth. The grooves improve the physical and magnetic qualities of the magnetic media, typically Ni—Co alloys, coated onto the surface of the disk substrate material, which is typically high purity Nickel-plated Al and Al—Mg alloys. Other currently used disk substrate media include ceramic and glass.

In either alternative processing approach equipment set-up, the processing is one-disk-at-a-time and the operations on each disk are serial, so that total operational through-put is a function of the total additive time of all process steps (i.e. loading, first texture, intermediate rinse, second texture, final rinse, and unloading), and the number of tape/nip roller finishing units, two per disk, one for each grade of abrasive tape. This in turn requires a large capital outlay for equipment and factory floor space, as well as increased equipment maintenance costs.

The texturing at each abrasive tape station is required to cease and the texture tape magazine is required to move laterally clear of the spindle while the disk is loaded on the spindle and accelerated to the process speed. The texture magazines must move laterally to the disk and the rollers closed to engage the disk in order to do the texturing step. Then the texturing again ceases, the rollers open, and the magazine moves aside laterally, upon which the disk rinses, the spindle winds down to a stop and is unloaded. There are additional time delays in transferring the disk to the next, downstream process, the finer level abrasive tape station for the second stage (fine grit) texturing. As disk size decreases, the total percentage of the total processing time of on-off handling, lateral back and forth movement and spool-up/spool-down increases.

As a result of the increasing demand for disk-based data storage systems, and the dropping financial margins as the disk areal data storage density increases, there is a need in the art for higher finishing processes through-put. Thus, faster processing systems are needed for tape-type finishing units that will convert the finishing processing to substantially continuous or multiple parallel through-put rather than the relatively slow, sequential one-at-a-time, single spindle operation of presently available systems, particularly for smaller disks of sizes less than 50 mm.

The Invention

SUMMARY OF THE INVENTION, INCLUDING OBJECTS AND ADVANTAGES

The inventive multi-station disk finishing apparatus, integrated system (called an MSU system) and continuous process method of finishing memory media disks for digital data storage systems in preparation for magnetic memory coating or post coating finishing and cleaning comprises four main sub-systems: 1) a Multi-Station Unit (MSU) comprising multiple driven spindles mounted on an indexable, rotary turntable assembly, preferably at stations oriented at 3, 6, 9 and 12 o'clock positions; 2) a tape finishing unit comprising at least two open/close tape heads, e.g., for fixed or slurry abrasive or non-abrasive texturing, wiping, buffing, burnishing, lubing/wiping or cleaning tape or pad units mounted on a base; 3) a robotic handler for loading and unloading disks onto/off at least one of the spindles; and 4) programmable and configurable multi-station system controller(s) that interface(s) with, monitors, integrates and controls the operations of the entire system, including synchronized loading/unloading by the handler, progressive rotation and operation of the MSU and finishing at the stations with the tape or pad units. The tape/pad unit sub-system includes its own programmable controller and sensors for control of the finishing tape advance, the control signals of which are selectively evaluated, including being monitored, intercepted, sampled, issued and reissued or passed through by the MSU system controller. The inventive MSU system includes an operator console with graphic display panel and input keyboard, and lubricant (e.g., water) supply and drain systems.

Although the description herein is, by way of example only, with respect to an abrasive tape texturing unit and texturing process involving fixed or slurry borne abrasive tape that is advanced step-wise between opposed pinch rollers defining a texturing nip into which disks are sequentially introduced for texturing, it should be understood that the inventive system, sub-assembly MSU unit, system controller, and method of finishing are each equally useful for all types of aggressive or abrasive cleaning applications, or post lube, buff/wipe applications to improve the quality of the media surface prior to pre-sputter cleaning, or post-sputter burnishing and glide certification of the disks. Thus the term "finishing" broadly covers all aspects of media disk surface preparation to improve the quality of disk-type memory media.

The multiple spindles and handler rotate relative to each other. In a preferred embodiment, the spindles are mounted in a rotating turntable assembly, which in turn is mounted on an oscillation pivot and drive assembly. The handler loads/unloads from a single position, preferably the 6 or 12 o'clock position, as the turntable sequentially rotates the disks into the load/unload station position. In a second, alternate embodiment, the spindles are fixed in position and a rotating handler, having multiple, open/close disk gripping devices for simultaneously loading/unloading disks from all spindles at once, is used.

In the preferred embodiment, the MSU system comprises a vertically oriented, power-driven turntable that rotates on a horizontal axis. The turntable includes a plurality of horizontally oriented spindles, examples of from 4 to 8 spindles being given, onto which disks can be mounted and indexed to be engaged by two or more tape finishing processing stations or magazines for finishing processing steps, the presently preferred embodiment of which finishing is abrasive tape texturing, in a substantially continuous operation. The rotating turntable assembly includes a rotary actuator for step-wise, indexed rotation and oscillation. The oscillation pivot and drive assembly also serves as the mounting chassis for the turntable. The oscillation assembly includes multiple drive linkages to in-dependently drive the spindles at each turntable index station position, and to oscillate the entire turntable on a pivot axis that is off-center with respect to the turntable axis but is coaxial with one of the spindles to provide relative motion of the disk substrate axial centerline relative to the finishing tape (abrasive) work surface. This motion is termed "pivoscillation." The center of the pivoscillation is preferably at the load/unload position. The rotations of the turntable, the oscillation (pivoscillation) and the spindles are controlled by the MSU system controller(s) that synchronize the operation of the sub-assembly units of the entire processing system.

In the case of finishing processing being abrasive tape texturing, the abrasive tape magazines, including the drive systems thereof, are preferably conventional, such as EDC Model 1800 texturing magazines, except that no lateral movement of the magazines is required in the inventive processing steps. That is, in the inventive multi-station disk finishing (example: texturing) system, disks are fed into the nip of the tape rollers (example: abrasive tape), rather than moving the entire complex and relatively massive magazines to a fixed disk position. In addition, in the inventive MSU system, unlike in the EDC texturing units, the load/unload station spindle does not rotate, so there is no spool up/spool down time loss. Although lateral tape finishing (example: texturing) magazine slides can be employed in the inventive system for moving the magazines for service or belt change-out and the like, they are not ordinarily utilized in the methods of this invention. The use of conventional magazines, such as the EDC Model 1800 magazines permits the instant inventive multi-station unit to be retrofit on EDC tape finishing units, which in turn extends the commercial life of those EDC machines and increases the production rate for disk media manufacturers without the need for substantial increases in machine footprint. That is, the same factory space can texture from 50% more to two or more times as many disks in the same platform footprint.

In a presently preferred first embodiment, the turntable includes four spindles, which are rotated (indexed) sequentially to four stations defined by the motor drive positions, in order: 1) on/off-load position; 2) coarse finishing step (texture, etc); 3) rinse; 4) fine finishing step (texture, etc), and then back to the on/off load position. A $1^{st}$ disk is loaded onto a spindle when it rotates into the on-load position, typically at the bottom, or 6 o'clock, position. The $1^{st}$ disk is then indexed, preferably counter-clockwise as seen from the disk side (front) of the machine, into the nip of a tape head (example: coarse texturing abrasive tape)at the 3 o'clock position, and that finishing process step (e.g., coarse texturing) proceeds. The 9 o'clock position is, in this example, the fine texturing or other finishing step position. No lateral movements of the tape finishers (e.g., abrasive tape texture magazines) are required, but the two working rollers of the tape unit magazine unit open and close as is conventional.

At the same time, a prior disk that is completing its cycle upon being rotated counter clockwise from the 9 o'clock, e.g., fine texturing position, to the 6 o'clock position, is rinsed, off-loaded, and a $2^{nd}$ disk is on-loaded at that 6 o'clock position (in shorthand: the 6-position). Upon the exemplary coarse texture being completed on disk 1, the turntable is indexed to rotate that disk up to the 12-position where it is scrubbed or/and rinsed. Meantime, a prior completed disk is off-loaded and a $3^{rd}$ disk is on-loaded at 6 o'clock. Upon the $2^{nd}$ disk completing the exemplary coarse texturing, the turntable indexes to bring the $1^{st}$ disk to the exemplary fine texturing station between the nip of the paired tape (e.g., abrasive tape) rollers of a second tape head (e.g., different, fine grade of abrasive tape or slurry) at the 9 o'clock position. Again, no lateral movement of the second tape magazine (e.g., the fine abrasive tape supply magazine) is required. The $2^{nd}$ disk is at the 12 o'clock scrub/rinse station, and the $3^{rd}$ disk is at the 9 o'clock exemplary coarse texture station.

The tapes in the two finishing (e.g., texturing) heads are synchronized so that the total dwell time is substantially equivalent in both finishing process stations, or the pressure on the rollers in the station that finishes (ends its processing step time requirement) first is relaxed (the working rollers are rotated open) or the disk rotation is stopped, so that there is no over-processing at whichever station finishes first. Although substantially equal dwell times is preferred for highest throughput, the inventive multi-station disk finishing system controller can initiate and control different process times on the left and right finishing (e.g., coarse and fine texture) stations. A spray nozzle keeps the disk at the shortest process station wet (bathed in lubricant or coolant) while the disk on the other side (station) is still processing. Preferably all stations include water or water mixtures fluid delivery spray nozzles to wet, cool or rinse the disks at each station, as needed, and the water or other fluid is supplied through a manifold system and routed to the spray heads aimed at both sides of the disks in the several processing station positions via fluid feed lines.

Finally, the $1^{st}$ disk completes it cycle, being rotated to the 6 o'clock position from 9 o'clock where it is scrubbed or/and rinsed, then off-loaded by the robotic handler.

With respect to the rinsing in the presently preferred embodiment, fluid streams or sprays are used at each station. In an alternate embodiment where desired, scrubbing may be performed at either or both the 12 or/and 6 station position(s). The scrubber head comprises a pair of short, fixed, counter-rotating brushes mounted on motor-driven, vertical, paired spindles. The mandrels, on which the brushes are mounted, may optionally have an internal water or other fluid manifold to provide a flow of flush water to remove particulates from the surface of the disk. That is, the brushes may be wetted externally by water spray or stream, or may be wetted by internal water manifolds, or both. The rotation of the turntable brings the exemplary coarse-textured disk up from the 3 o'clock position to the 12 o'clock position into the nip of the counter-rotating scrub/rinse rollers. Preferred brushes for the rollers are PVA or urethane foam of the type shown and described in ODI Cascade Scrubber Patent U.S. Pat. No. 6,588,043, the disclosure of which is hereby incorporated by reference.

As to the optional lower, second scrub/rinse station, located at the 6 o'clock position, the brushes are vertically (or horizontally) mounted on a similar counter-rotating, motor-driven paired spindle head, as with the first station. In addition, the scrub head is mounted at its base on a lateral slide. The brushes are moved laterally into the 6 o'clock position, receive the exemplary fine textured disk in the nip between brushes, rotate, scrub or/and rinse, then withdraw to the side so the robotic handling system can remove the disk and insert a fresh disk for processing.

The brushes in both scrub/rinse stations extend along a radius to the center hole of the disks being processed. It should be understood that the scrub/rinse stations are optional assemblies, and that the inventive disk finishing system can be provided without one or both scrub heads. Where they are not provided, it is preferred to rinse the disks at the 12 position, and at the 6 position, or during texturing, or in transition between positions with a DI water spray or water stream. A suitable collection sump system, comprising a gutter, catch-basin and drain, is provided.

In both systems, with and without scrub heads, an X-shaped splash deflector assembly, preferably including drip vanes or shrouds, is provided. The splash deflector assembly is secured to a front splash plate of the turntable assembly and has apertures through which the spindle/collet assemblies project. It rotates with the turntable and provides four distinct, defined zones, one for each station, in which the splash and abrasion debris is confined. This prevents loosened, large grit, if any, from getting into and contaminating a disk undergoing fine texturing. Optionally, a suction system may be provided at the central apex of each of the four splash deflector zones that withdraws the texturing operation water or the scrub water as the case may be. In an alternate embodiment, one or more suction-draw or drain holes are provided adjacent to but spaced outwardly from the turntable spindle, adjacent to the apex of each splash deflector zones. Preferably, the outer edge of each splash deflector drip vane includes a crimp that stiffens the deflector wall and provides a drip edge. In the preferred embodiment, the amount of water used is very small, and the catch basin is located below the 6 position to catch the drips or run-off from the turntable splash deflector assembly.

Thus, the turntable has 3 or more disks in four or more stages of continuous processing. The turntable could include more or less than four stations, e.g., Three (off-on load; coarse texture; fine texture; with rinse occurring as the disk rotates from coarse to fine positions); Five (more than two grades of abrasive tape head stations); Six (a double Three, two side-by-side of each of the three stations); eight (a double Four, two side-by-side of each of the exemplary four stations); and the like more station configurations. The entire multi-station disk finishing system assembly, including the main sub-systems: Multi-Spindle processor unit (MSU) and finishing tape units, can be oriented horizontally.

In a second configuration of the principal embodiment, the geometry of the turntable is modified to hold 8 disks, in four pairs. The robotic handler functions in either of two modes: A) it can load two disks side-by-side at a time, or B) it loads one, then spaces (moves over) laterally to load a second so they are side-by-side. The tape head is also modified to include 2 pairs of work (load or pinch) rollers, mounted one above the other, and spaced to be located, respectively, on the center lines of the side-by-side disks. An idle roller or rollers system is located between the pairs of work rollers. Each pair opens and closes substantially simultaneously (unless one disk of the pair finishes first) as the pairs of disks arrive at each station simultaneously. There are 8 driven spindles on the turntable, and the center of pivoscillation rocking is generally midway between the 2 disks at the load/unload station (the 6 position). The tape advance is skip-indexed so that fresh tape is available for the lower head between the tape segments used by the upper head of the tape head pairs (assuming a single reel of fresh tape is fed from the top). In alternate embodiment, each work roller pair has its own dedicated tape supply/take-up system. The tape controller program is essentially the same, but configured for paired heads. The turntable diameter is larger and the tape head sub-assemblies are located farther apart to provide space for the greater number of disks. This 8-up configuration also permits ⅛ turn indexing with 6 processing stations, optionally each different, for different types, or progressive, finishing at each successive station.

The turntable assembly includes a rotary actuator assembly that comprises a bearing supporting the turntable center shaft (axle) and a gear and indexing drive motor to rotate the turntable at controlled intervals. The rotary actuator is mounted in a housing that in turn is mounted to the pivotable turntable assembly mounting plate, which is part of the oscillation pivot and drive assembly. Each spindle includes a collet (mounting boss) at the outside (forward) end thereof for receiving and gripping a disk by its center hole. The opposite (back) end of the spindles include drive surfaces (such as gears or friction drive rollers) for contacting direct traction drive rollers or belt drives of the spindle drive motors, which are mounted on the oscillation pivot and drive assembly (which in turn functions as the turntable assembly mounting chassis). In a preferred embodiment, servo or stepper drive motors are employed to drive the 9- and 3-position spindles. Synchronous motors may be used to drive the 6- and 12-position spindles. The spindles can be controled to rotate in either direction, and the same or opposite direction, at each station.

The spindle disk-retaining collets open and close at the on/off load station (6- and/or 12-position) by means of a push rod and paddle actuator mounted on the base plate just forward of the rotary actuator of the turntable assembly. The spindles may be air pressurized to prevent water infiltration. The indexing of the rotary actuator may be enabled by servo or stepper motors, Geneva mechanism, or pneumatic or hydraulic actuation.

In an alternate embodiment, where the 9- and 3-position texture stations spindles are driven by belt between the motors and an idler roller, an additional belt can be used off one of those two motors to drive the 12-position rinse station location, or/and the 6-position load/unload station spindles. The on-off load spindle need not be, and preferably is not driven, but where it is, it can include an actuatable brake member to bear against the drive surface or spindle axle for quick stop of the spindle.

The oscillation pivot and drive sub-assembly of the inventive disk processing system includes pivot bearings and a turntable assembly mounting plate so that the entire turntable assembly selectively, as the processing step protocol, menu or recipe calls for, can be rocked along an axis that causes the disks to oscillate in a lateral (horizontal) amplitude range of from about 0.025" (±0.0125") to about 0.125" (±0.0625") during texturing. The oscillation is centered at the axis of the load/unload station spindle, e.g., the 6-position, so the arc of oscillation is along a line generally diagonal to the axis of the nip rollers of the abrasive tape magazines, e.g., in the presently preferred embodiment, that diagonal is about 45°±5°. In an alternate embodiment, the tape unit magazines may include a driven cam that provides a radial oscillation of the abrasive nip along the radius of contact with the disk being finished. It should be understood that for some fininshing operations, the amplitude of oscillation can be more or less than others, can vary in time during the dwell at that particular station, can be turned off at a particular station or turned on or off part way through the processing step at a particular station. The processing program is configurable to provide a wide range of recipies (sequence of processing steps).

The oscillation pivot and drive assembly also includes a rocker arm and cam follower sub-assembly that is driven by a belt and motor mounted on the base plate to provide the controlled pivoscillation. In an alternate configuration, the pivoscillation is created by a motor and linear drive assembly (such as a lead screw). In that embodiment, the motor drives back and forth, using a sinusoidal acceleration profile. In the inventive system, the cam follower assembly is linked to an oscillation arm. The oscillation arm is pivotally linked to a first end of a connecting rod, the opposite end of which rod is pivotally linked to a gusset (spacer) plate spanning between the rear pivot block and the turntable assembly mounting plate.

The turntable mounting plate both pivots and oscillates on an axis that is coaxial with the axis of the load/unload spindle. In the preferred embodiment, the oscillation assembly gusset plate is sandwiched between and serves as the connection between a rear bearing retainer plate and a front plate to which the turntable assembly is mounted. The front mounting plate includes the forward bearing retainer. Thus, these front and rear plates receive the aligned bearings of the bearing block, and the axis of those bearings functions as the pivoscillation pivot point.

In the principal embodiment, the geometry is substantially as follows: the turntable rotational pivot is at the center of a circle, the connecting rod is pivoted at a height approximately coordinate with the 3 o'clock position, and the pivoscillation pivot is at 6 o'clock. The connecting rod can be connected above or below the 3 o'clock position, and instead of being connected to the gusset, it can be connected to the back of the front mounting plate to which the turntable is mounted.

The pivoscillation permits simultaneous oscillation of three of the spindles, e.g., at the 9, 12 and 3 positions. However, the spindle at the on/off load position (e.g. 6 position) neither rotates or oscillates from side to side since the 6 position spindle axis is coaxial with the pivoscillation axis. Thus, the disk on/off loading robot arm can load and unload disks from the 6 position even while the turntable is oscillating during texturing at the 9 and 3 o'clock positions. And, the continuity of the inventive operation is not halted during those process steps; that is, the process is virtually continuous, not one-at-a-time intermittent. In another embodiment, the individual spindle drive motors can be independently oscillated, with the spindles being suspension mounted to provide selective, different oscillation at each station.

The inventive turntable system is mounted in association with conventional dual, spaced finishing tape head magazines (the exemplary using abrasive tape) oriented face-to-face and orthogonal to the plane of the turntable. The turntable disk spindle chucks extend sufficiently far from the face of the turntable so that the disks, as mounted on the respective spindle chucks, may be inserted sequentially in the respective nips of the load rollers of the tape heads. That is, there is sufficient projection of the spindles/chucks that the downwardly projecting tape load roller pairs, mounted on their respective tape magazine assemblies have sufficient operating clearance to rotate on horizontal axes oriented normal to the spindle axes, and to open and close. The turntable diameter is selected so that the two tape roller head assemblies, being located on opposite edges (9 and 3 positions, respectively) of one side of the inventive turntable assembly, are spaced sufficiently far apart that they do not interfere with each other's operation, and there is no cross contamination of abrasive or spray between them.

Suitable tape units that may be used in the inventive system include the Model 1800 Disk Finisher tape systems from EDC of San Mateo, Calif. However, in the inventive system and multi-spindle unit, it is not required that the tape heads (magazines) move laterally, as is the case in the EDC Model 1800. In the EDC unit, where only one, fixed spindle is used, opposed, spaced tape heads (magazines) must alternately move laterally into position to first one radius (both faces simultaneously), then away, after which a second tape head moves into position along an opposite radius, then away. In the EDC Model 1800, both tape magazines must be laterally retracted to allow room for its disk handler to load or unload the disks at the single spindle.

The inventive multi-spindle disk finishing system includes one or more micro-processor-based control unit(s), herein, "system controller(s)", operated by configurable software or firmware, typically loaded into flash memory, that synchronize(s) the operational cycling of the turntable assembly to the operation of the robotic handler and the finishing tape units, but does not interfere with the process operation of the finishing tape magazines or the load/unload robotic handler. That is, while selected signals involved in the operation of the tape heads and handler may be monitored and/or detected by the synchronizing system controller of the inventive multi-spindle turntable system, those signals essentially are synchronized with the signals originating from the system controller so that those sub-assemblies continue to work as designed with the multi-spindle unit for optimum process operations. The inventive disk texturing system controller(s) is/are electronically inserted between the finishing tape unit controller the magazine sensors, the turntable and oscillation sub-systems, and the robotic handler to evaluate, monitor, satisfy, sample, delay or pass through, signals to/from those sub-systems, the various sensors, and the display and operator console.

In the alternative to evaluating signals from sensors or controllers of the handler and tape units, additional sensors, independent of the sensor system(s) provided with the conventional EDC tape units and the handler units, can be mounted to the inventive system to detect the state of motion of the tape and tape drive rollers and load rollers, (or the speed, duration and pressure thereof) and the amount of tape advance. Similarly, independent sensors can be added to detect the positions of the robotic handler lifter, grippers, and the disks (e.g., disk presence, disk lubricated sensors). Data from these added sensors can be used to synchronize the rotation of the turntable, the spindles, drives, open/close of the collets, the oscillation drive, lubrication or cleaning sprays, and the loading and unloading of the load/unload spindle by the robotic handler.

The tape head magazines ordinarily are supplied with or linked to a tape unit control system that includes strain gauges and transducers to measure and control tape advance speed and tape tension simultaneously, while providing a quantitative evaluation of the actual work being performed at the step/substrate interface in the nip of the load rollers. Since the force (tension) on the output side of the tape should equal the force on the take-up side, including the drag due to the work occurring at the load roller interface, comparison of the loaded vs. unloaded forces on the two sides gives a measure of the actual work being done during the texturing operation. This is also referred-to as the "work factor." By simultaneously establishing a constant tape speed and tension, the work factor may be continuously monitored by calculating the difference between the tape tension on the two sides of the load rollers. In practice, to prevent unwanted oscillation due to fluctuations in tape tension monitoring, it is preferable to set a fixed load, e.g. selected to be an empirical average, which is achieved the coarse the amount of closure of the rollers, i.e. the amount of pinch force.

This leads to straight-forward microprocessor control of the finishing (texturing) system tape head assembly. The tape speed is measured by a transducer measuring the shaft rotation of a guide roller adjacent to the supply reel, while the shaft speed of the take up reel motor is likewise measured with a transducer. The difference between the two, where the tape tensions are balanced in the unloaded condition, is used to calibrate the shaft speed of the take up motor to the actual speed of the tape. This permits determination of the shaft speed needed to drive the take up reel motor to sustain a programmed tape speed for a given texturing operation. Tape speed and tension measured by the strain gauges associated with the idler rollers are controlled by servo-mechanisms interfaced to a microprocessor-based computer which executes one or more pre-selected processing programs. These servo mechanisms comprise conventional closed-loop control systems that are easily enabled by those skilled in the art so that the servo-mechanisms alter the delivered take up reel motor power until the actual tape speed and tension matches the pre-selected programmed values input into the control application by the operator. In turn, the values from the tape head control system add to the load roller dwell time, that is, the time to process the disk in each of the coarse texture station and the fine texture station.

Thus, the inventive system includes at least one system controller(s) that interfaces with the three main electromechanical subsystems; the pivoscillating, indexing turntable with rotating spindles; the tape finishing unit(s), heads and magazines; and the robotic disk handler (load/off-load). For retrofit with EDC finishing units, selected signals (cable(s)) from the mechanical/electro-mechanical elements/devices of the tape magazines are re-routed into the inventive system controler(s) for evaluation, selected from intercepting, monitoring, sampling and delaying, or reissuing, while others are passed through, i.e., remain routed straight to the original tape unit/subsystem controller. Of the re-routed tape and handler elements/devices/signals, some are simply monitored (for high/low condition) and their condition, timing and source are input into the MSU controller(s) as history data and/or confirmation of event and the like. Other signals may be delayed, processed, or satisfied, as needed, to synchronize the tape unit operation to the turntable rotation, and/or robotic handler operation. For example, when the tape unit controller signals the magazines to retract, the inventive system controller simply satisfies that signal by answering back with a high condition signal. The magazines do not retract but the tape controller "thinks" they have, having been satisfied by the inventive system controller high condition signal response. Of course, the system controller issues its own original signals as part of the menu of signals processing involved in the synchronizing of operations of the inventive system.

Thus, the system controller is programmable to initiate (trigger on time and in synchrony) by issuing signals relating to each operational step of the entire system: robotic on-load at 6 position station, including clamp (open) of the collet; turntable indexing rotation to 3 position station; spin up of 3-spindle; closing of first processing step tape head rollers; rotational finishing (e.g., texturing) at 3-station; water supply to 3-station; open 3-station tape head rollers; stop of spindle (if desired); indexing to 12-position; rinse; indexing to 9-position with second processing step (e.g., $2^{nd}$ grade of texturing); index to 6-position with stop of spindle and unclamp (close) of collet for off-load; and all of these steps appropriately timed for the 4 disks continuously in process.

In addition, a separate controller in the inventive system (or optionally as an integrated portion of the system controller, called a Communication Interface Unit (CIU), interfaces with the communication streams of the tape unit controller or/and the handler controller to manage the error messages and display at the operator console. The CIU controller also accepts communication streams coming from a remote computer interface (for troubleshooting and process recipe download). The CIU can interface with the control console of the tape unit. This permits the tape unit console message display to operate seamlessly with the requirements of the MSU system controller for the inventive multi-spindle process. The CIU can use messages being sent to the display by the tape unit controller for logistic coordination, such as intercepting the normally immediate message to the operator to discard a mis-processed disk on the original tape unit single spindle, and redisplay that message later when the mis-processed disk is finally moved by the indexing turntable to the load/unload, 6-position. It is also capable of displaying messages generated by the system controller for operation of the inventive multi-spindle disk texturing system in the console display.

In the inventive MSU/CIU system controller(s), the detected or monitored times to process the disk in the various finishing (e.g., coarse and fine texturing) stations are compared and equalized so that the stopping of the spindle rotation and indexing of the turntable are synchronized to the tape magazine operation. This results in the finishing operation being essentially continuous, and there is no over-processing (e.g., over-texturing, coarse or fine) in one station while awaiting the other to complete. The typical finishing processing step time is typically far longer than is needed to off-load one disk from the 6 position station and to reload that station. It will be clear to those skilled in the art that suitable closed-loop control systems are easily enabled by those skilled in the art so that PLCs, microprocessors, sensors and servo-mechanisms can be used in the inventive multi-spindle turntable and robotic handling assemblies to synchronize their operation to the tape unit sub-systems, thereby creating a continuous, faster processing operation that has a significantly greater throughput than present EDC one-disk-at-a-time tape units.

There is an occasional need to reject a disk. For example, the texturing roller pressure or texturing station (3 and/or 9 position) dwell time may be too long. When this is detected, an error signal is generated by the affected tape head sub-assembly. The error signal is intercepted and routed to the MSU/CIU controller and then processed (optionally including archiving for reports) and timed to be issued by the system controller to the robotic handler as a discard signal to remove the disk as it gets to the 6 o'clock (load/off load) position station and discard it. That is, if the error signal occurs due to an error in the coarse texturing, the disk is at the 3 o'clock position. The error signal must be kept associated with that disk, and only that disk. It would not be appropriate to send the discard signal immediately, as the disks ahead of it at 12, 9 and 6 o'clock are good disks, and letting the discard signal straight through would result in discard of the disk arriving at the 6-position, a good disk. Thus, the MSU/CIU controller times relay of the discard signal (or reissues it) to the robotic handler as the bad disk arrives at the 6 o'clock position. The robotic handler receives the discard signal, removes the bad disk from the 6-spindle, and drops it into the discard tray or alerts the operator to remove it by hand by a signal or message to the display panel (or audio alarm, or both), of the operator console.

One skilled in the art will appreciate that many alternative embodiments of the inventive concepts and principles may be designed. For example, the system may be set up for a single grade of abrasive tape, say a grade midway between coarse/coarse and fine. That can be at the 3-position, with a simple kiss/wipe at the 9-position. Or handlers can alternately load/off load at both the 6 and 12 positions, so that one turntable produces twice the number of disks. Disk 1 is loaded at 6 position and off loaded at 12, while disk 2 is loaded at 12 and off-loaded at 6-position with the single, mid-grade texturing at both 3 and 9-positions. Finishing processes other than texturing are part of the inventive system, control strategy and method.

Likewise in some data storage systems, such as 1" disks having an areal density of 4–16 MB per side, useful for example in cameras and cell phones, only one side of the disk is coated with magnetic media. In such cases, disks can be processed in the inventive system in adjacent relationship, that is, two disks, back-to-back substantially in contact or with a protective or cushioning spacer there between, so that Side A of disk 1 is textured or otherwise finish processed by one roller, and Side B of disk 2 is textured or otherwise finish processed simultaneously by the other roller in the roller-pair head of the texture unit. The robotic handler picks back-to-back disks out of the arriving cassette and loads them on the 6 or/and 12-position spindle collets, or sequentially loads two disks on each collet.

With respect to improved texturing production (by way of example of a finishing process), the inventive multi-spindle turntable unit installed to integrate with a pair of EDC 1800 tape magazines has a 72% increase in production: 184 disks per hour compared to the original 107 disks per hour, along with increase in texture time and rinse/clean time:

| | EDC 1800 | Inventive MSU System | % Increase |
|---|---|---|---|
| Throughput, disks/hr. | 107 | 184 | +72% |
| Texture 1, seconds | 15 | 15 | same |
| Rinse 1, seconds | 2.5 rinse | 15 rinse/clean | +600% |
| Texture II, seconds | 2.5 | 15 | +600% |
| Rinse II, seconds | 2.5 rinse | 7 rinse/clean | |

It should be understood that the direction of rotation of the turntable can be reversed to be clockwise (6, 9, 12, 3 and 6, in sequence), and the load spindle may be at the top, 12 o'clock position, rather than the 6 o'clock position.

In connection with robotic handler subsystems, there are a wide range of commercially available handlers that can be used, such as those available from Unmanned Solutions International, Inc. (USI) of Fremont, Calif.; Exclusive Design Company of San Mateo, Calif.; Owens Design Inc. of Fremont Calif.; Komag, Inc. of San Jose, Calif.; and the like. A wide variety of disk pick up and holding devices can be used, such as grippers, fingers, suction cups, lifters and the like. Typically, the handlers have controllers that permit selection and configuration of disk handling steps, sequences, duration, dwell and pause times, degree and angle of rotation, etc. so that the operator of the inventive Disk Finishing System can create a suitable operational "recipe" of steps in which the entire system is in synchrony.

In the second principal embodiment, the relative rotation of the spindles and the handler is simply reversed. That is, instead of the rotating spindles being mounted on a turntable and a single gripper assembly being oriented to interface with a single load/unload station, e.g., the 6 o'clock position as in the 4-up turntable (carousel) configuration of the above-described preferred embodiment, the handler utilizes a turntable with multiple gripper assemblies. In this second principal embodiment, three (or optionally, four) fixed (station dedicated) spindles are used (the on-off station spindle may optionally rotate or not), with the fourth position (where only 3 spindles are used) being the initial load station from the cassette delivery. Four sets of gripper assemblies are used on the handler turntable oriented to simultaneously load or unload disks from all stations at once. The grippers grip all 4 disks at once, the disks are released from the spindles, the handler retracts, taking away the disks as held in the grippers a pre-selected distance from the spindles (just enough to rotationally clear them, say 1"), the gripper turn-table rotates 90°, and replaces the disks on the next spindle in the processing line or array. The fourth position is the cassette supply station, e.g., at 6 o'clock which includes a lifter to raise disks out of the cassette to an elevated position where the handler gripper can retrieve it. To initiate the process, the handler rotates the gripper turret to the cassette disk supply lifter position, receives a first disk, and then rotates and mounts it at the 3 position. When the processing is done at 3, it takes that disk off and simultaneously receives a second disk in a second gripper on the gripper turntable. Then the handler turntable rotates the first disk to 12-position, and the second to 3-position. A third, empty gripper arrives at the disk cassette lifter station at the 6-position and retrieves a third disk. The rotation of the gripper turntable repeats, and now the handler has 3 disks, the first at 9, the second at 12, and the third at 3. On the next cycle, the first disk is delivered to the lifter for replacement in the outgoing (completed) end of the cassette.

Although multiple cassettes may be used, e.g., loading un-finished disks onto the inventive processing system from a first, incoming cassette and unloading the finished disks into a second, outgoing cassette, it is preferred to more simply unload the cassette starting at one end and reloading starting from the same end. That is, the cassette unload/reload sequence is first unload-first reload, with a floating gap of 3 or 4 disks between the finished and unfinished disks. That way, the batch in each cassette remains together, which permits more accurate accounting on a "cassette batch" basis. Where a disk is removed, a gap may be left in the cassette, if desired for a visual on the number of defective disks in a batch.

With respect to other types of finishing, as noted the inventive apparatus, processes and control systems can be used generally with any type of aggressive cleaning or improvement of the media surface prior to pre-sputter cleaning, or post-sputtering smooth-out of lube, providing a final clean wipe prior to, or to accomplish burnishing for the glide certification step so that completed media disks can be forwarded to final assembly into drives, such as CPU or portable hard drives, cell phones, recording devices, cameras and the like electronic devices.

For example, for aggressive or abrasive cleaning applications based on indexing tape systems as in the inventive system which are done in lieu of, or after, texturing, the various positions may be as follows:

As a first example, e.g., for Perpendicular Media Recording (PMR) technology or other data media not requiring a texture orientation for improvement in magnetic performance, this example gives a smoother final substrate surface finish in the as-delivered polished substrate condition:

Station 1: Cleaning tape with proper fluid, using either fixed or free abrasive-type tape. In the former, an abrasive is adhered to a Mylar or other type film tape. In the latter, where the tape plus freely flowing abrasive slurry in a lubricant or/and coolant fluid is used, a cloth or fibrous tape that acts as a transport and carrier for dispensing the chemical treating, lubricating, cooling or abrasive particles of the slurry into contact with the disk surface to be treated or finished;

Station 2: Rinse, e.g. with DI water, or soap (detergent/surfactant) in water, or alcohol in water, fluid mixtures;

Station 3: Cleaning cloth tape with cleaning and/or rinsing fluid, such as above in Station 2 process step. Wiping tapes such as supplied by Tex Wipe company or Thomas West, Inc. are suitable;

Station 4: Rinse and load/unload. Optionally, a drying fluid may be used, such as an alcohol in water to reduce the surface tension. Examples include isopropyl alcohol, acetone and methanol, including hot IPA/DI water mix, or a polar organic compound that dissolves in the carrier liquid at room temperature or below. Mixtures of the polar organic compound with a hydrophobic organic compound, e.g., hydrofluoroether, perfluorocarbon and hydrofluorocarbon fluids may be used to assist drying.

As a second example, after the disk is sputter coated with magnetic media or/and a protective carbon layer is done in the sputtering machine, the disks are dipped and slowly withdrawn from a lubrication fluid to leave a thin, 30–50 Å layer on the disk to provide smooth glide of the read head, the disk may be processed by the inventive system in a buff/wipe application where the purpose is to smooth out the lube and provide a final clean wipe prior to burnish/glide certification step. For this application the various postions may be as follows:

Station 1: Abrasive application via a fixed abrasive tape with or without coolant or cutting lubricant fluid;

Station 2: (Optional) OD wipe or in-situ inspection of surface, e.g., by laser scatterometry; load/unload;

Station 3: Cleaning cloth tape with or without cleaning fluid (See prior Example);

Station 4: (Optional) OD wipe or in-situ inspection of surface (see Station 2); load/unload.

Note that where the OD wipe is not needed or desired, the disks can be off loaded. Thus, this is a two step process, with disks alternately loaded at 6-position, processed at 3-position, and off loaded at the 12 position, while a second disk is loaded at 12, processed at 9-position and unloaded at 6. Thus, where the disks are single-sided and processed adjacent (back to back), the instant system processes 4 at a time.

A third application is similar to the second above where burnishing is achieved in appropriate stations, e.g. at the 3 and 9 positions in preparation for lubing and glide test certification.

Those skilled in this art will appreciate that the inventive system has a wide range of process applications to which it can be easily adapted in the disk finishing industry.

BRIEF DESCRIPTION OF THE DRAWINGS

The invention is described in more detail with reference to the drawings, in which:

FIG. 1 is a series of three isometric views from the front side of the inventive disk finishing system comprising a multi-spindle unit mounted below and in operative association with a tape finishing unit comprising a pair of spaced, opposed tape head sub-assemblies (magazines), a robotic handler and a mounting cabinet containing the system controller, in which

FIG. 2 is a series of three enlarged, assembled isometric views from the front and back sides of the multi-spindle unit sub-assembly, in which

FIG. 3 is a series of four isometric partly assembled and exploded views of the several sub-assemblies of the inventive disk finishing system, in which

FIG. 7 is a series of three elevation schematic views of a second, 8-up embodiment of the inventive multi-spindle unit that can be integrated into the disk finishing system, in which

DETAILED DESCRIPTION, INCLUDING THE BEST MODES OF CARRYING OUT THE INVENTION

The following detailed description illustrates the invention by way of example, not by way of limitation of the scope, equivalents or principles of the invention. This description will clearly enable one skilled in the art to make and use the invention, and describes several embodiments, adaptations, variations, alternatives and uses of the invention, including what is presently believed to be the best modes of carrying out the invention.

In this regard, the invention is illustrated in the several figures described above, and is of sufficient complexity that the many parts, interrelationships, and sub-combinations thereof simply cannot be fully illustrated in a single patent-type drawing. For clarity and conciseness, several of the drawings show in schematic, or omit, parts that are not essential in that drawing to a description of a particular feature, aspect or principle of the invention being disclosed. Thus, the best mode embodiment of one feature may be shown in one drawing, and the best mode of another feature will be called out in another drawing.

All publications, patents and applications cited in this specification are herein incorporated by reference as if each individual publication, patent or application had been expressly stated to be incorporated by reference.

One skilled in the art, upon detailed analysis of the attached drawings and text will be enabled to construct and operate the inventive disk finishing system in accord with the principles described above in view of the parts being called out and numbered in accord with the attached parts list. The drawings show the parts from several views so that their configurations, connections and functions are clear to those skilled in the art.

Figure 1A:
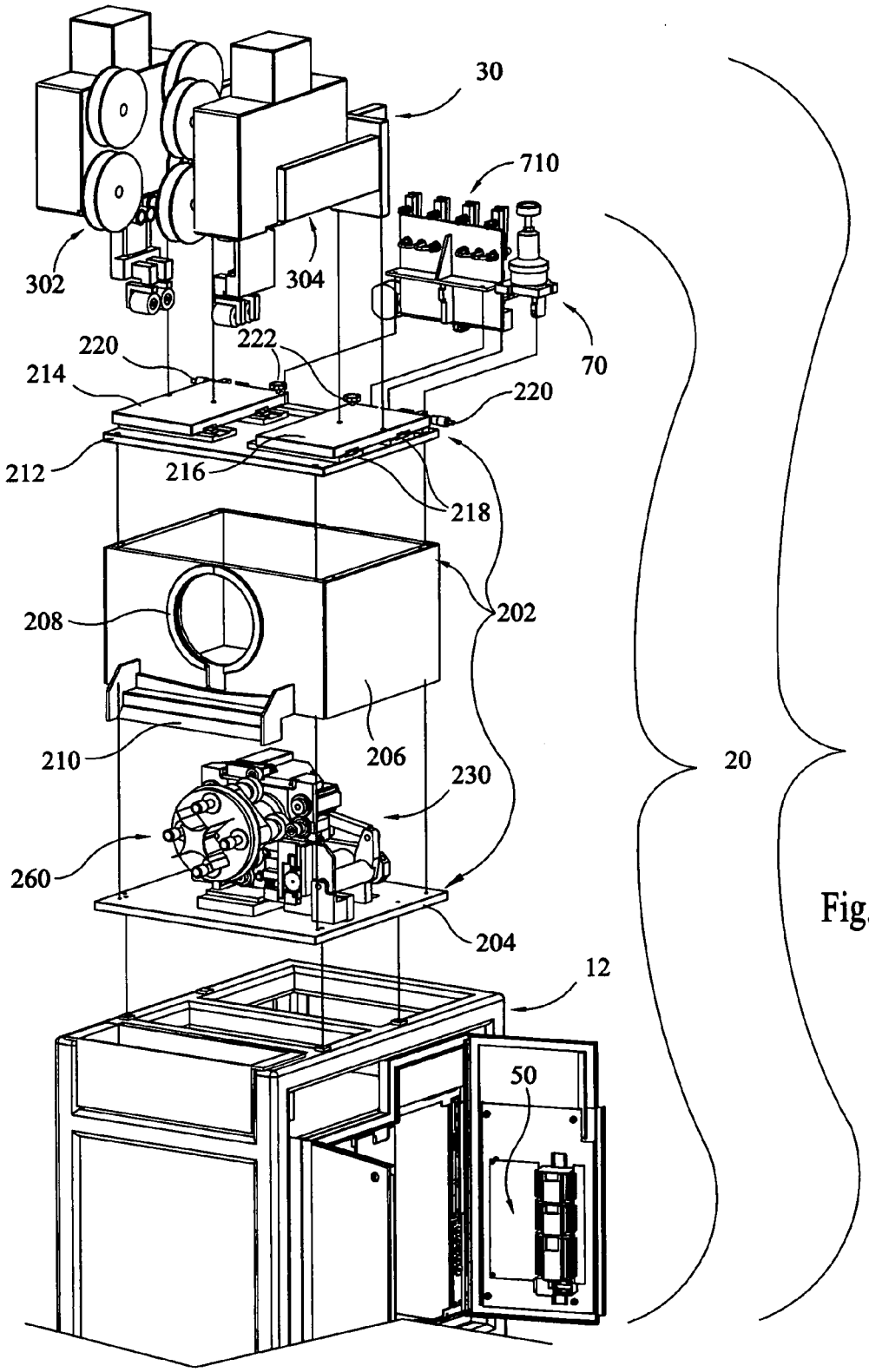
FIG. 1A is an exploded isometric view from the front, right side without the handler or the operator console.
Figure 1B:
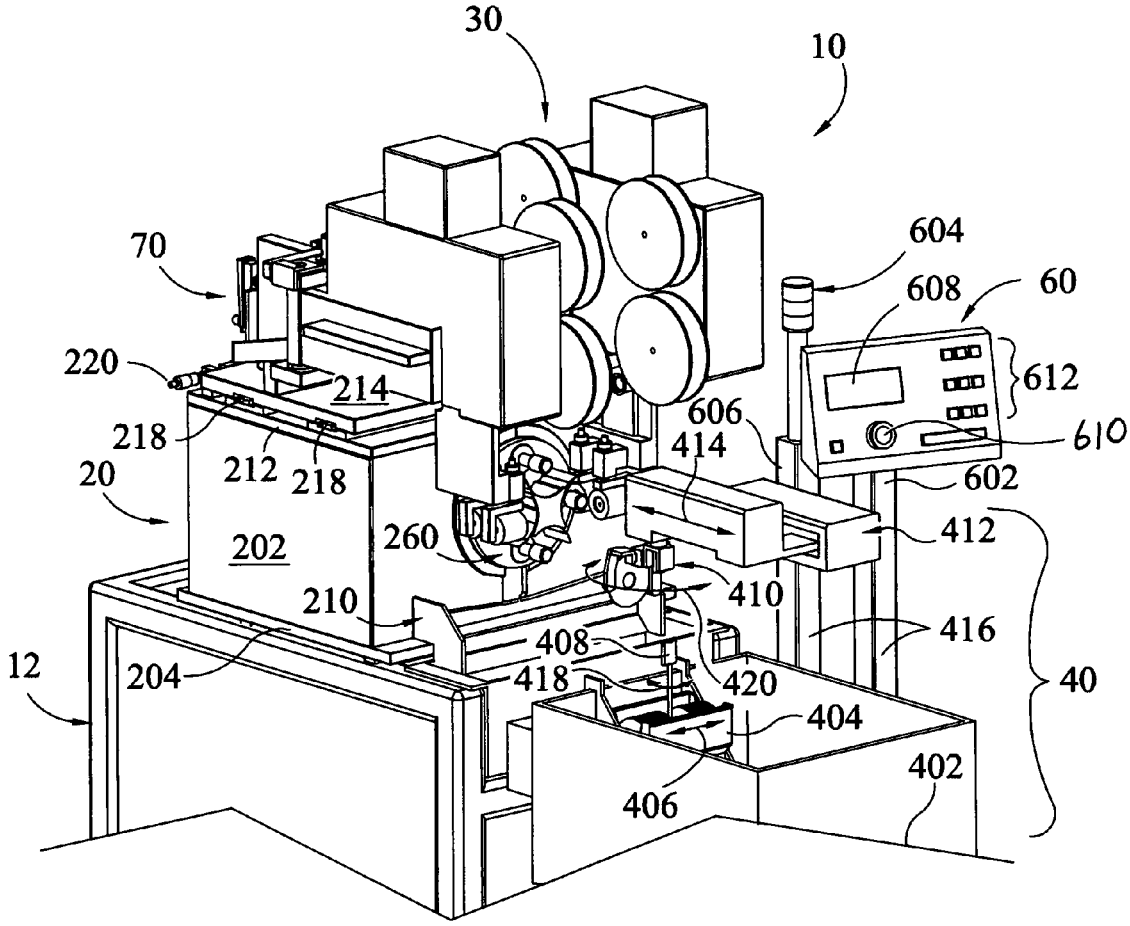
FIG. 1B is an assembled isometric view from the left, front side showing the handler in position and the operator console.

FIG. 1 is a series of three isometric views from the front side of the inventive disk finishing system 10. FIG. 1A is an exploded isometric view from the front, right side without the handler or the operator console, both of which are shown in FIG. 1B. The disk finishing system 10 comprises a base cabinet 12 on which are mounted as sub-assemblies: a multi-spindle unit (MSU) 20; to which is mounted in operative association a tape finishing unit 30 comprising a pair of spaced, opposed tape head sub-assemblies (tape magazines) 302 and 304; a robotic handler 40; and at least one system controller 50. For clarity, the system power and control wiring for electrically and electronically connecting the sub-assemblies, the controller, the power supply and the operator console are not shown, but the wiring is straightforward for those skilled in the art. The operator console 60 may be fixedly mounted to the cabinet 12 via support bracket 602, or may be movably positionable on its own stand, with appropriate umbilical cabling (not shown) routed between it and the various sub-assemblies via the cabinet. A condition alarm light 604 is also mounted on bracket 604. The finishing lubricant system 80 is secured to the back of the MSU housing 202.

The MSU housing assembly 202 comprises a base plate 204 to which are mounted the oscillation pivot and drive sub-assembly 230 and the turntable sub-assembly 260. Side walls 206, having a plurality of access ports (most not shown for clarity) support the top plate 212. The front side wall includes an aperture sized to receive the turntable turret so that the spindles and the splash shroud extend through it for access by the handler and the load rollers of the tape finishing unit. A drip tray 210 is secured to the front wall to receive run off of lubricant from the disks during processing.

Figure 4:
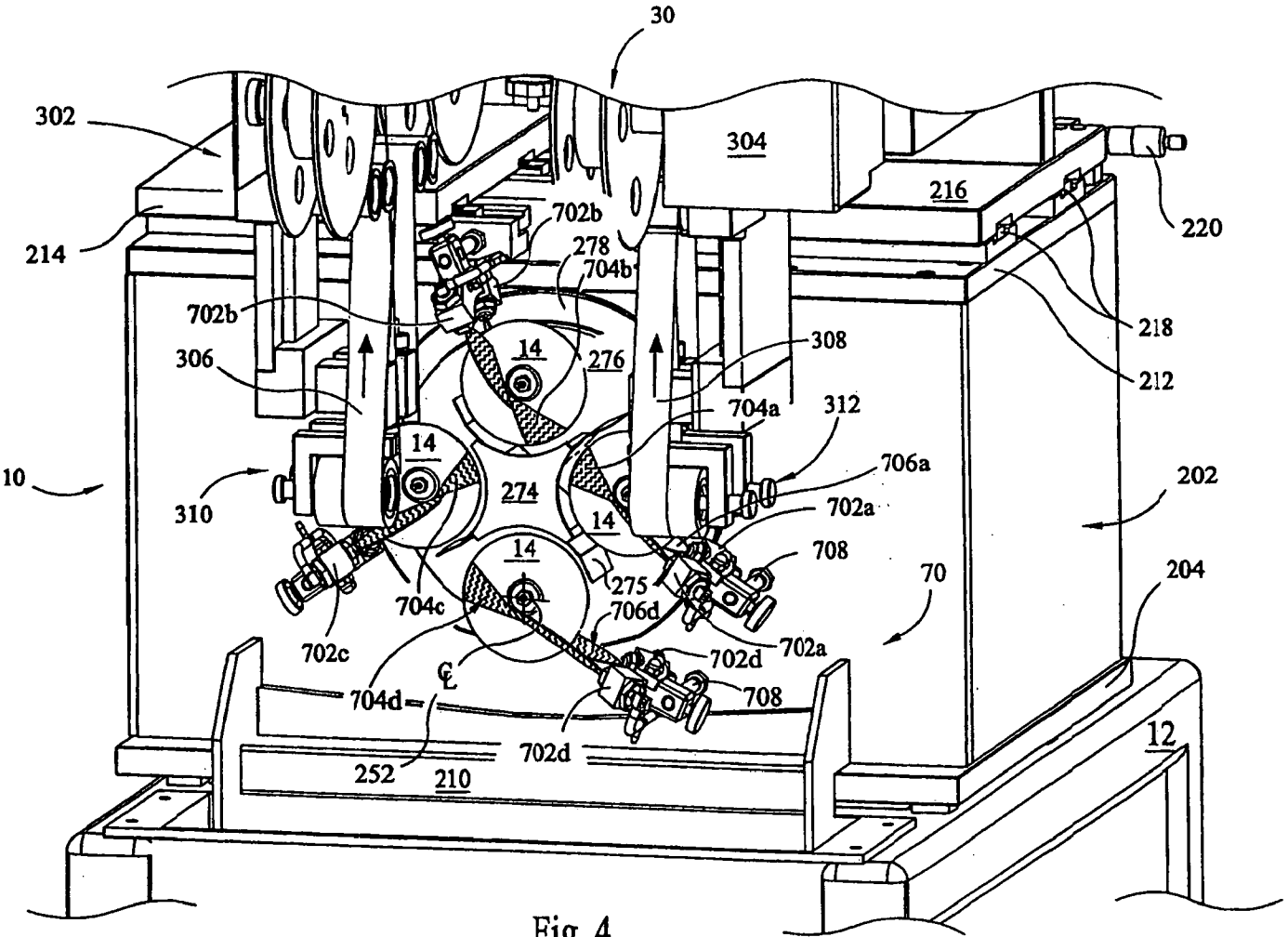
FIG. 4 is an isometric assembled elevation view from the front, right side of the inventive disk finishing system with the handler removed for clarity, showing in operation the contact of finishing tapes simultaneously from both the left and right magazines of the tape finishing unit, as well as the lubricating spray heads and spray paths onto the disks.

A pair of base plates 214, 216 are mounted via slides 218 to the top plate 212, and the tape finishing unit magazines 302, 304 are secured to the respective base plates 214, 216. A pair of magazine micrometer adjustment mechanisms 220 are provided for precise lateral positioning of the load rollers to cover the full radial dimension of the disks at the 3-o'clock and 9-o'clock positions, the micrometer moving the magazine base plates 214 and/or 216 relative to the top plate 212. Knob type hand clamps 222, by way of example, secure the magazine base plates 214/302 and 216/304 in position against movement, once properly positioned by their respective micrometers. The lubricant supply system 70 includes a plurality of electronically actuatable metering valves secured to the back wall of the housing and tubing to the spray heads (as best seen in FIG. 4) for distribution of lubricant fluid, as needed.

FIG. 1B is an assembled isometric view of the disk finishing unit 10 of FIG. 1A from the left, front side showing the handler 40 in position and the operator console 60. The handler includes a base cabinet 402 that functions as the input station for the groups of un-textured disks that are incoming in cassette 404. The cassettes are placed on a carriage (not shown) that increments laterally, as shown by arrow 406 during load and unload to bring a disk or empty slot into alignment with the lifter that rises from beneath the open-bottom cassette. For the load steps of the operational cycle, the lifter yoke 408 lifts successive disks out of the cassette, then raises and rotates each disk 90° (arrow 418), so that the plane of the disk is orthogonal to the axis of the spindle collet. The gripper assembly 410 grasps the disk by the out edge, as shown, and the linear transfer mechanism 412 advances the disk into engagement with the collet, as shown by arrow 414. The collet is retracted as the center hole of the disk advances over it; the collet then expands gripping the disk by the center-hole edge. The linear transfer mechanism 412 is supported on brackets 416 secured to a side wall of the cassette station housing. In an alternative, the lifter yoke 408 does not rotate (no arrow 418). Rather, it lifts the disks straight up with the disk plane oriented to intersect the axis of the spindle collet. The gripper assembly 410 grasps the disk as before and it rotates 90° as shown by arrow 420, to advance and load the disk on the spindle-mounted collet. The unload steps of the cycle are the reverse, placing the finished disks back into the cassette in the same order that they were removed.

Figure 1C:
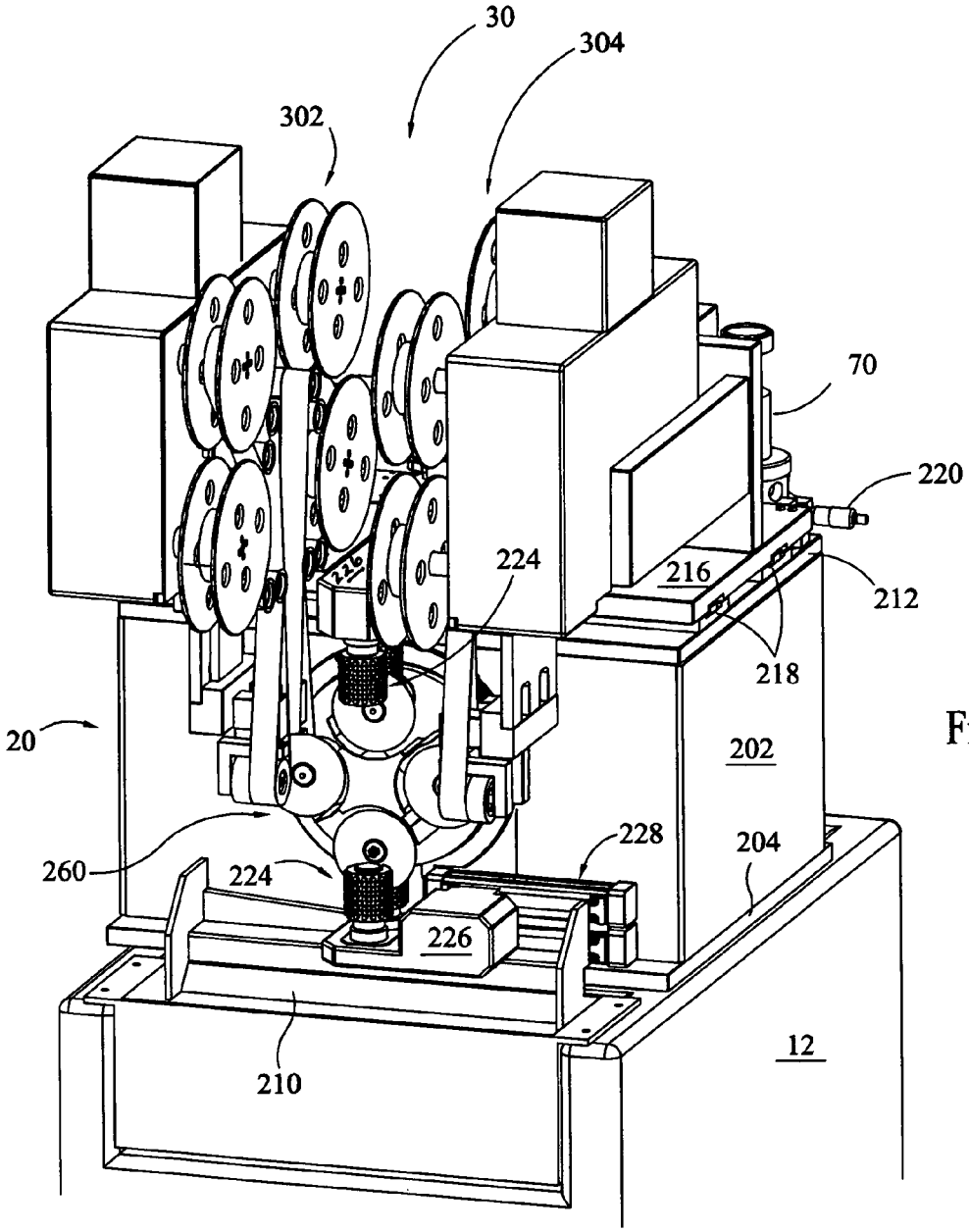
FIG. 1C is an assembled isometric view from the front, right side with the handler removed to better show the finishing tapes and optional disk scrubbers at the 6- and 12-positions.

FIG. 1C is an assembled isometric view from the front, right side with the handler removed to better show the finishing tapes 306, 308 of the magazines 302, 304, respectively, and optional disk scrubbers 224 at the 6- and 12-positions. The scrubber head comprises a pair of short, fixed, counter-rotating brushes mounted on motor-driven, vertical, paired spindles assembly 226. The mandrels, on which the brushes are mounted, may optionally have an internal water manifold to provide a flow of flush water to remove particulates from the surface of the disk. That is, the brushes may be wetted externally by water spray or stream, or may be wetted by internal water manifolds, or both. The rotation of the turntable sub-assembly 260 brings the coarse-textured disk up from the 3 o'clock position to the 12 o'clock position into the nip of the counter-rotating scrub/rinse rollers. As to the optional lower, second scrub/rinse at the 6 o'clock position station, the brushes are vertically (or horizontally) mounted on a similar counter-rotating, motor-driven paired spindle head, as with the first station. In addition, the scrub head is mounted at its base on a lateral slide 228. The brushes are moved laterally into the 6 o'clock position, receive the fine textured disk in the nip between brushes, rotate, scrub or/and rinse, then withdraw to the side so the robotic handling sub-system can remove the disk and insert a fresh disk for processing. The brushes in both scrub/rinse stations extend along a radius to the center hole of the disks being processed. It should be understood that the scrub/rinse stations are optional assemblies, and that the inventive disk finishing system can be provided without one or both scrub heads.

Figure 2A:
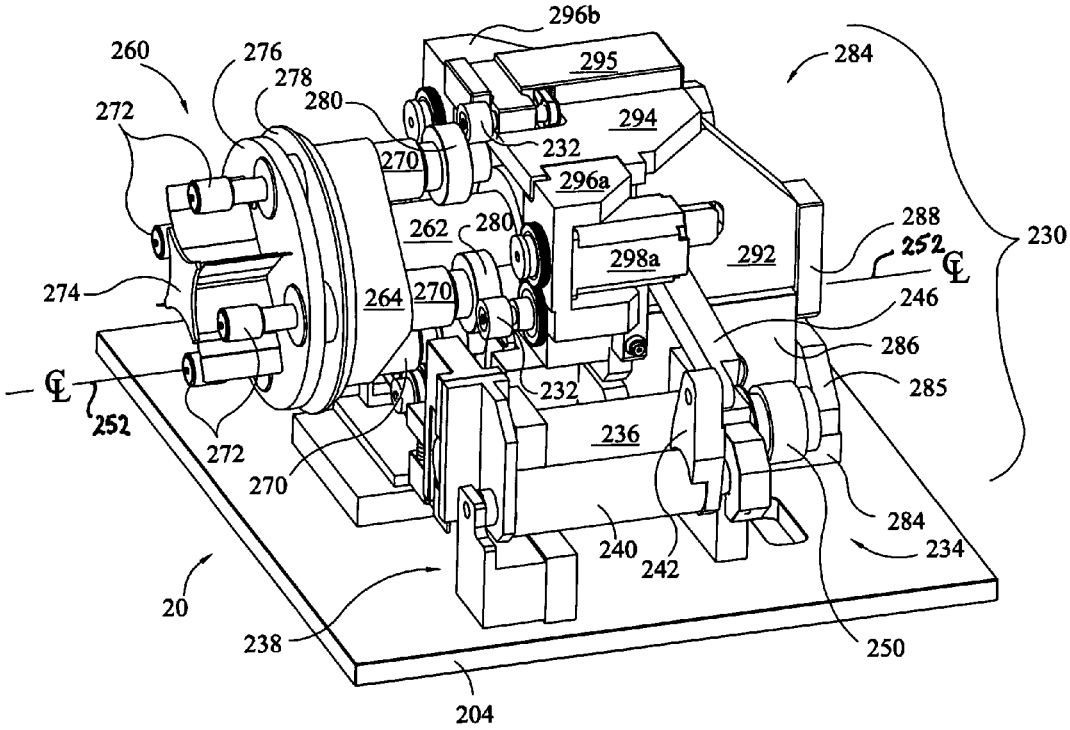
FIG. 2A is an assembled isometric view from the right, front side showing the turntable sub-assembly with its splash deflector shroud assembly, the oscillation pivot and drive sub-assembly with cam follower, oscillation arm and connecting rod for the pivoscillation motion.

FIG. 2 is a series of three enlarged, assembled isometric views from the front and back sides of the multi-spindle unit sub-assembly 20 with the housing removed to reveal the parts. The pivoscillation axis is shown in these figures as CL 252. FIG. 2A is an assembled isometric view from the right, front side showing the turntable sub-assembly 260 on the left, and the oscillation pivot and drive sub-assembly 230 in the center foreground and back right side. The turntable, from right to left as shown, comprises a central axle tube 262, on the outer end of which is secured a turret 264 carrying, in this embodiment, four spindles 270 (270*a*–270*d*, respectively). The forward end of each spindle (to the left) carries a collet 272 (272*a*–272*d*), that is internally actuated by a spring biased plunger (not shown) as is conventional in the art. Forward of the turret 264 is a generally X-shaped (as seen in elevation) splash shroud 274 assembly that creates 4 individual zones, one for each spindle. The splash shroud assembly 274 includes and is secured to a front splash plate 276 through which the spindle collets extend. A seal plate 278 may be used between the splash plate 276 and the turret 264 to prevent lubricant (water) from entering through the aperture 208 (see FIG. 1) that receives the splash plate. The spindles 270 in this embodiment are driven by direct frictional contact of spindle drive rollers 280 (280*a*–280*d*) in contact with traction drive rollers 232 of the spindle drive motors, described in more detail below, as they are a part of the oscillation pivot and drive sub-assembly 230.

In the presently preferred embodiment it is the oscillation pivot and drive sub-assembly 230 that serves as the mounting for the turntable assembly 260. The oscillation pivot and drive assembly 230 provides two functions: First, it pivotably supports the turntable and provides the pivoscillation motion during processing. Second, it provides a mount for the drive motors for the spindles so that they move with the oscillation so that the spindles rotate at selected constant rate during the processing.

The oscillation pivot and drive sub-assembly 230 is mounted on the base plate 204, and comprises oscillator sub-assembly 234 and turntable pivoting mount sub-assembly 282. The oscillator 234 comprises a fixedly mounted cam drive assembly 236 (torque tube) and a cam follower assembly 238 (including a reaction roller) that pivots shaft 240 to which it is attached at a forward end. At the rear end of the follower pivot shaft 240 is mounted an oscillation arm 242 to which is pivotally mounted a connecting rod 244 which imparts the pivoscillation motion to the turntable mounting plate. The drive axle 236 is driven by a motor 246 via drive belt 248 and pulley 250, best seen in FIG. 2B.

Figure 2B:
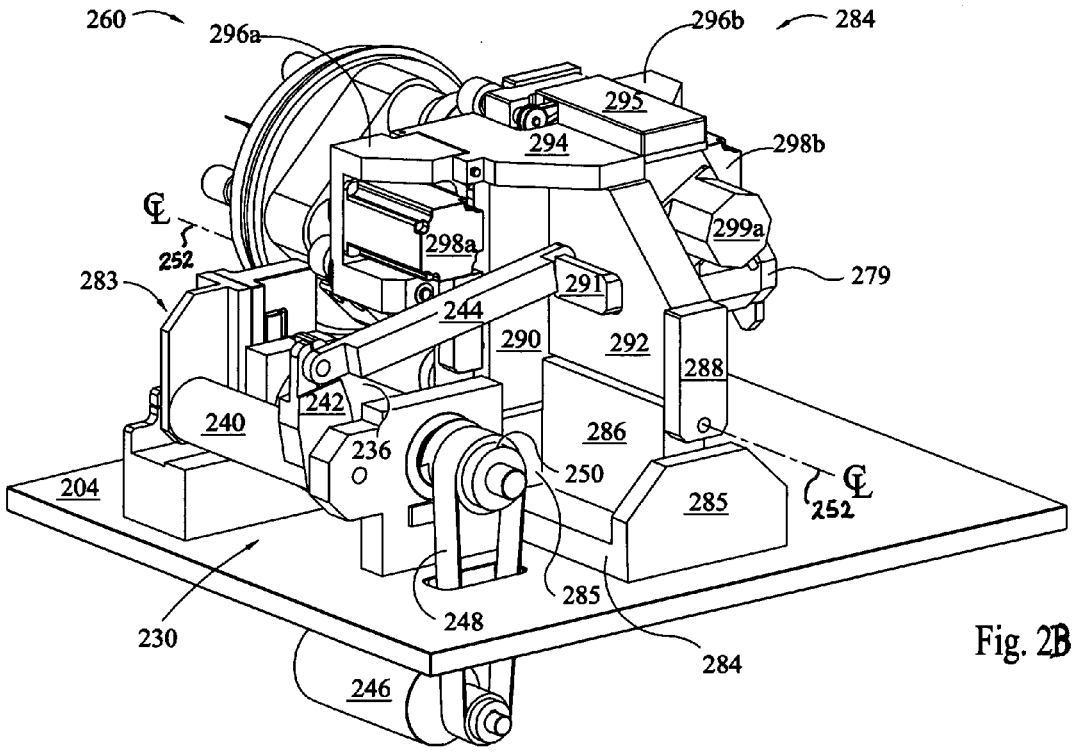
FIG. 2B is an assembled isometric view from the rear, left showing the drive for the oscillation sub-assembly and the connecting rod pivots.

FIG. 2B is an assembled isometric view from the rear, left of the multi-spindle unit showing the drive for the oscillation sub-assembly comprising motor 246, belt 248 and pulley 250 secured to the axle of the oscillator cam drive assembly 236 (the cam is at the forward end of this assembly). The pivoting mount assembly 282 comprises a base plate 284, the rear half of which comprises a generally U-shaped bracket portion 285 (as seen in side elevation), to which a bearing block 286 is secured between the up-turned bracket ends. The bearings of the bearing block are pivotally received in rear pivot block 288 and the forward turntable mounting plate 290. The rear block 288 and turntable mounting plate 290 are spaced by gusset 292 which carries a side pivot 291 to which the connecting rod 244 is linked. This linkage transfers the oscillation motion to the turntable mounting plate 290, the axis of the oscillation being at the axis, CL 252, of the bearings as shown. As an alternative, the connecting arm could be pivotally linked to the back of the turntable mounting plate 290. Top plate 294 carries a plurality of spring-biased hinged motor brackets 296, two being shown, bracket 296*a* for the 3-position spindle drive motor 298*a*, and 296*b* for the 9-position spindle drive motor 298*b*. It also carries the belt drive 295 for the 12-position spindle drive motor 299. A similar motor, 299*b* (best seen in FIG. 3D) for the 6-position is mounted on the base plate below the turntable assembly.

Figure 2C:
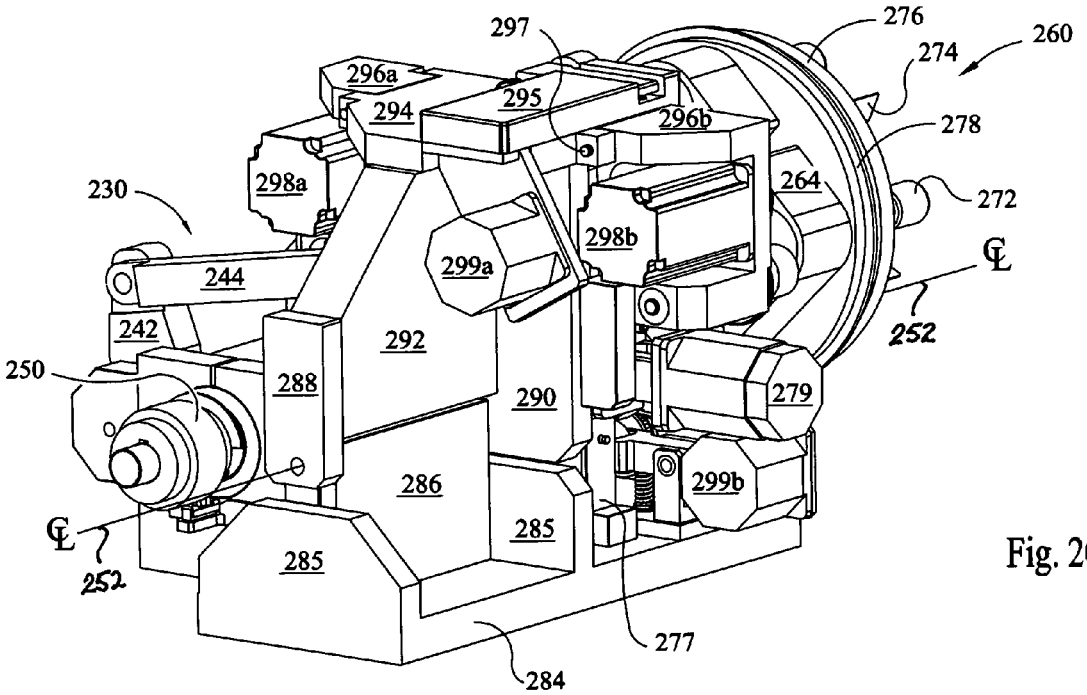
FIG. 2C is an assembled isometric view from the rear, right side showing the location of the turntable mounting plate and spindle and turntable drive motors.

FIG. 2C is an assembled isometric view from the rear, right side of the multi-spindle unit showing the location of the turntable mounting plate and the spindle and turntable drive motors. In this view, the base plate 204 is not shown for clarity, but the numbering of parts is the same as in FIGS. 2A and 2B. The pivot 297 for the spindle motor bracket 296*b* is clearly shown, as are the forward 9-position drive motor and the rotary actuator motor 279. The collet actuator 277 is partly visible, mounted to the forward end of base plate 284 (forward of the bracket portion 285).

FIG. 3 is a series of four isometric, partly assembled and exploded views of the several sub-assemblies of the inventive disk finishing system described above in FIGS. 2A–2C. Compare FIG. 3A to FIG. 2A. FIG. 3A is a partly assembled view from the right, front side with the oscillator assembly 234 removed, except for the connecting rod 244, to show the pivoting mount assembly 284 in relation to the turntable assembly 260. In addition, the 3-position spindle drive motor 298*a* has been removed for clarity. The forward 6-position spindle drive motor is visible as is the collet actuator 277, both mounted on the forward end of the mounting plate 284.

Figure 3A:
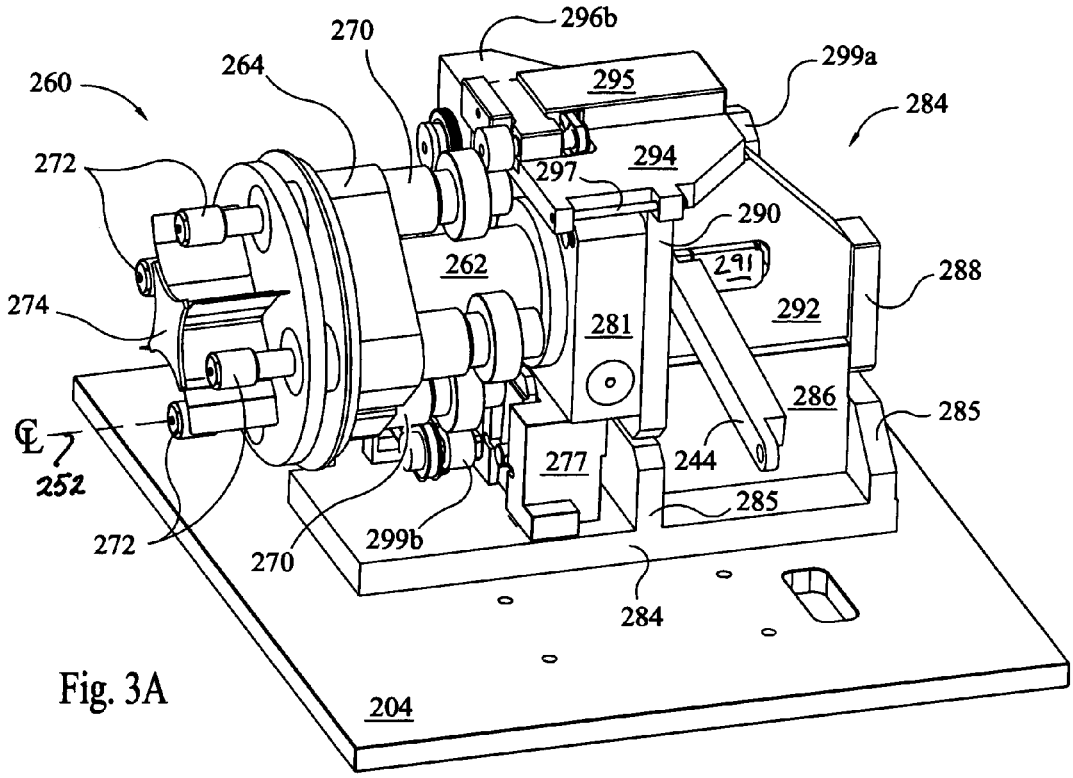
FIG. 3A is a partly assembled view from the right, front side with the oscillation pivot drive removed to show the pivoting mount assembly for the turntable, and with the spindle drive motors removed for clarity.
Figure 3B:
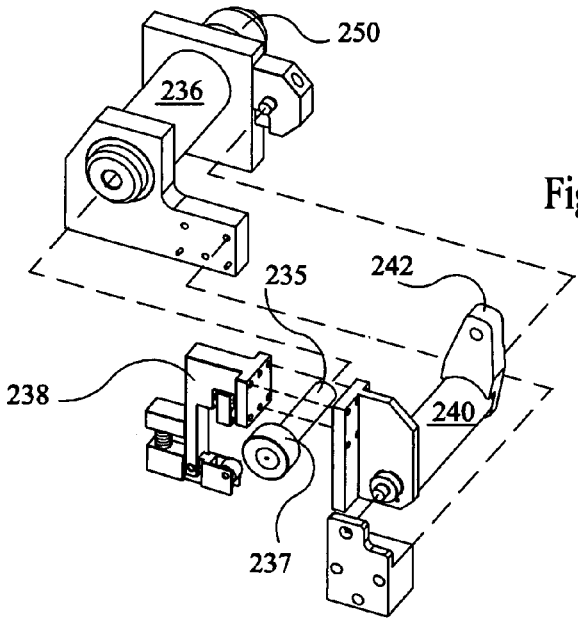
FIG. 3B is an exploded view from the front, right side of the oscillation cam follower sub-assembly without its drive.

FIG. 3B is an exploded view from the front, right side of the oscillator assembly 234, showing the torque tube 336 on mounting blocks receiving the drive axle 235 which at its rear end carries the pulley 250 and at its forward end the cam 237 with an eccentricity that provides a a lateral (horizontal) oscillation with amplitude in the range of from about 0.025" (±0.0125") to about 0.125" (±0.0625") during texturing. The cam follower sub-assembly 238 rides on the cam and imparts motion to the follower pivot shaft 240 journaled in end blocks as shown to impart the oscillation to the arm 242, which is linked to the connecting rod 244 shown in FIG. 3A.

Figure 3C:
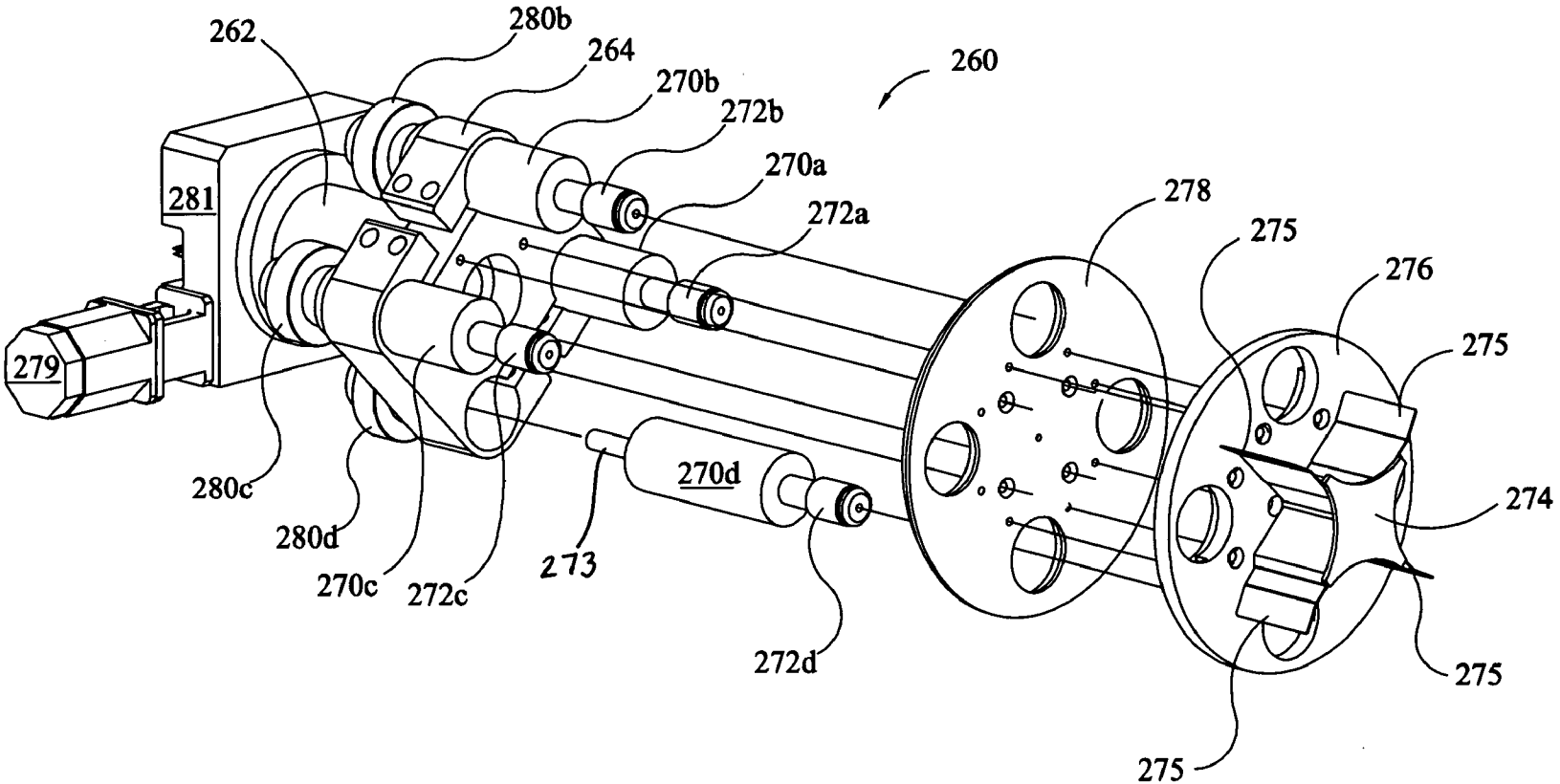
FIG. 3C is a partly exploded view from the front, left side of the turntable sub-assembly showing its splash shroud sub-assembly.

FIG. 3C is a partly exploded view from the front, left side of the turntable sub-assembly 260 showing its splash shroud sub-assembly 274 attached to splash plate 276 and mounted to seal plate 278. Note the shroud includes terminal vanes 275 that have crimps for strength, and which provide a drip edge. The actuator motor 279 powers the gear-driven rotary actuator 271, which turns the turret axle 262, on the outer end of which is mounted the turret 264 in which the spindles 270*a*–270*d* and collets 272*a*–272*d* are mounted. The drive wheels 280*a*–280*d* lie between the rotary actuator and the turret. The collet actuator rod (not shown is slidably movable in the collet center tube 273.

Figure 3D:
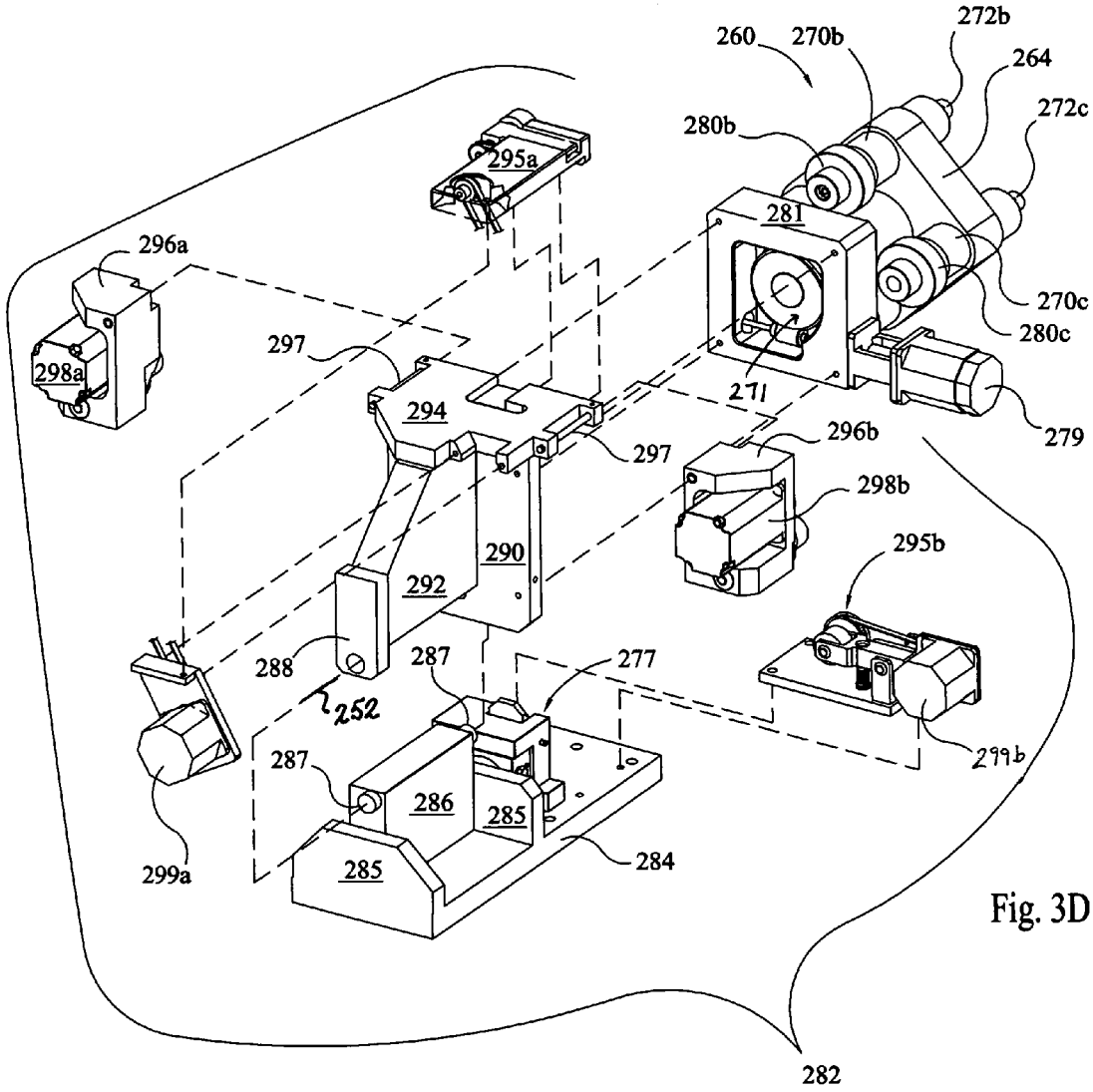
FIG. 3D is an exploded view from the rear, right side of the pivoting mount and turntable sub-assemblies, showing the relationship of the spindle drive motors to the turntable assembly.

FIG. 3D is an exploded view from the rear, right side of the pivoting mount sub-assembly 282 and the turntable sub-assembly 260, showing the assembly relationship of the various pivot blocks and spindle drive motors, as well as the relationship of the turntable sub-assembly to its mounting plate 290. At the upper right is the turntable assembly 260; in this view the gearing 271 of the rotary actuator 281 is shown in the housing. The dashed lines show that the rotary actuator 271 is mounted to the front side of the mounting plate 290. The 3-position and 9-position motors and brackets 296*a*/298*a* and 296*b*/298*b* are hung from the pivot pins 297 on each side of the top plate 294. The 12-position drive motor 299*a* is mounted to the back edge of the top plate 294, and belt drive and jack shaft drive train extends over the top right side of the plate. The 6-position drive motor 299*b* and drive train 295*b* are shown mounted to the forward end of the base plate 284. The collet actuator assembly 277 is mounted just forward of the bracket 285. Note the bearings 287 mounted in the bearing block 286 are received in corresponding bearing bore holes in the rear pivot block 288 and the mounting plate 290. The spacing between the bottom of gusset 292 and the top of the bearing block 286 permits the oscillatory pivoting of the entire turntable mounting assembly 288, 290, 292 and the top plate 294 and motor mounts 296*a*, 296*b* on pins 297.

FIG. 4 is an isometric assembled elevation view from the front, right side of the inventive disk finishing system 10 with the handler 40 removed for clarity, showing in operation the contact of finishing tapes 306, 308 simultaneously from both the left and right magazines of the tape finishing unit, as well as the lubricating spray heads 702*a*-702*d* and spray patterns 704*a*–704*d* (front side of disk) and 706*a* –706*d* (back side of disk) onto the disks 14*a* –*d*, in the respective 3-postion, 12-position, 9-position and 6-position stations. Note four pairs of nozzles 702*a*–702*d* are dedicated, one to each station, with one nozzle bathing the front of the disk 14 and the other bathing the back side with lubricant, such as DI water, or DI water with one or more alcohol(s) and/or surfactant(s) for cleaning. Each tape magazine assembly includes a pair of openable/closable load rollers 310, 312 which guide the tapes 306, 308 (four tapes, two each side, one for the front of the disk, one for the back where both sides of the disk are finished, e.g., textured, polished, burnished, wiped or oiled) into engagement with the surfaces of the disks 14 upon rotation into the roller nips by the turntable assembly. Lubricant is supplied via supply lines 708 from the supply manifold 710 (see FIG. 1A). The center of the pivoscillation is the center of the 6-position station collet, identified as "CL".

Figure 5:
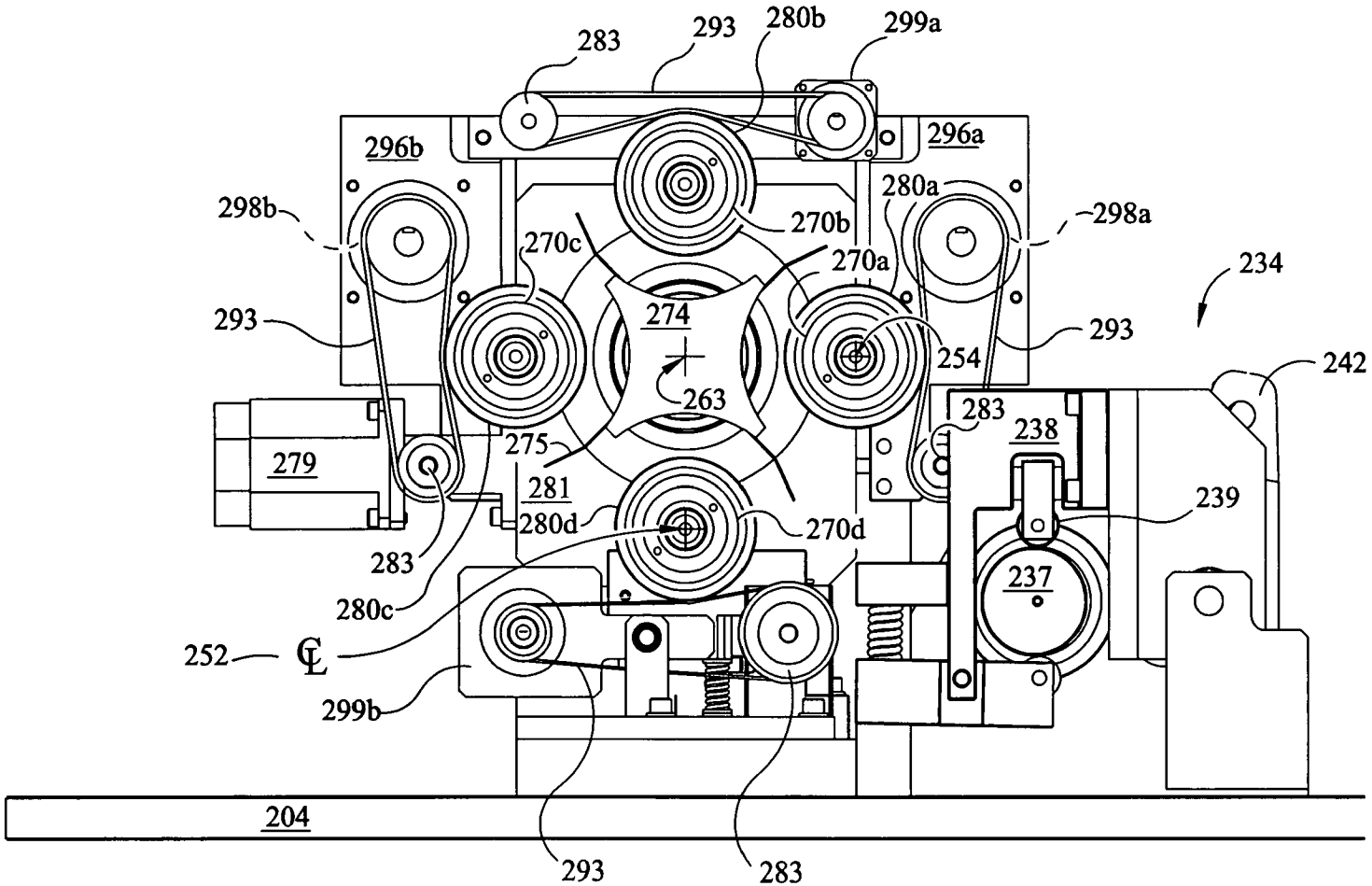
FIG. 5 is a front elevation of the inventive multi-spindle unit showing an alternate belt drive system for driving the spindles.

FIG. 5 is a front elevation of the inventive multi-spindle unit showing an alternate belt drive system for driving the spindles, comprising the drive motors 298*a*, 298*b*, 299*a*, 299*b* driving idler rollers 283 via belts 293. The belts contact the drive rollers 280*a*–280*d* of the spindles 270*a*–270*d*. The center of rotation of the turntable is shown at 263, and the center line of the pivoscillation is shown at the 6-position as 252. Note that the center 254 of the 3-position is the approximate level of the center line of the connecting rod pivot 291 (see FIG. 3A). This figure also most clearly shows the roller 239 of the cam follower assembly 238 riding on and following the cam surface 237 to provide the oscillation around the center line 252.

Figures 6, 6A, 6B:
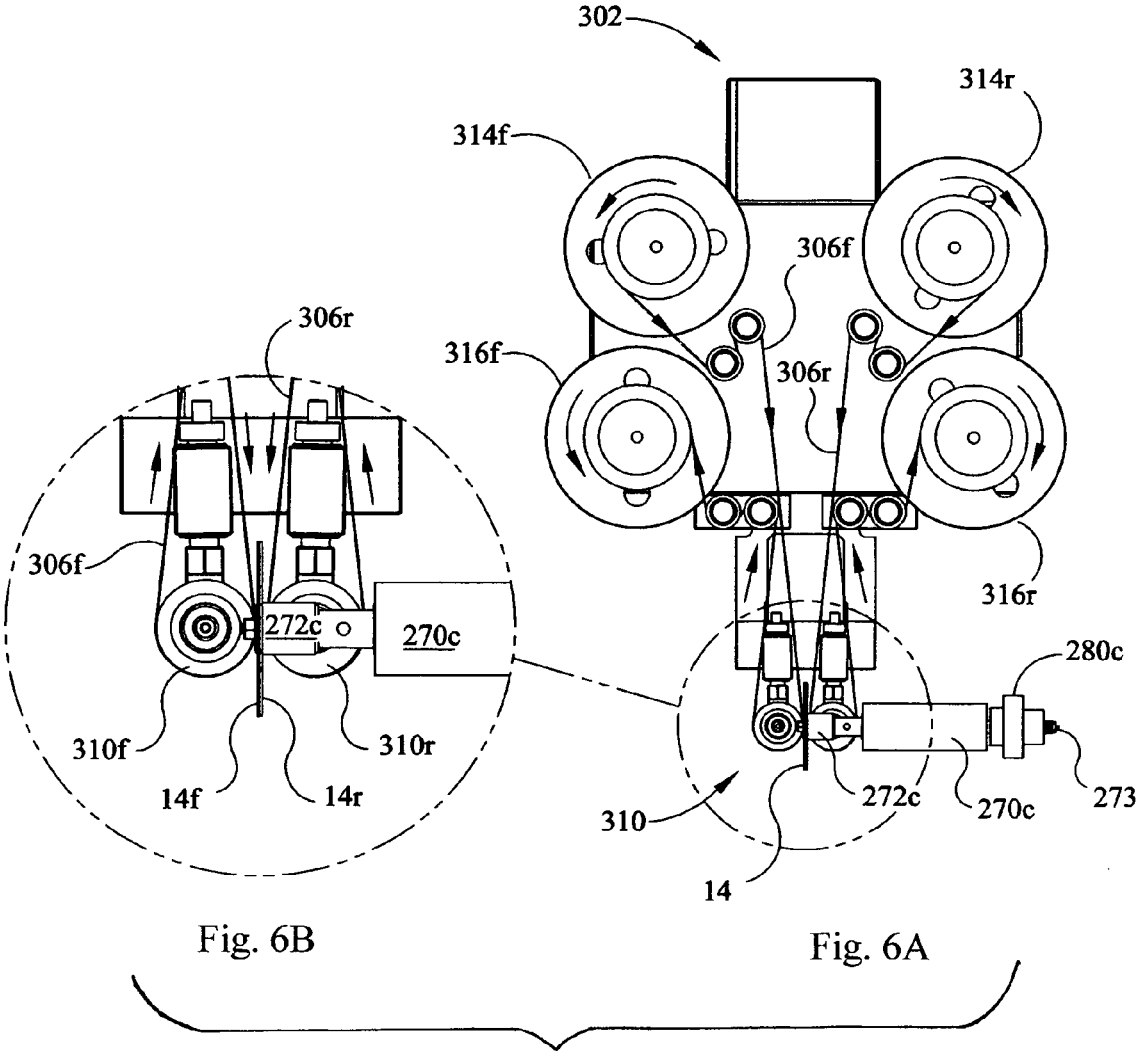
FIG. 6 is a pair of schematic side elevation views of a finishing tape magazine engaging a disk being processed in the 9-position station, with FIG. 6A being a full view and FIG. 6B being an enlarged view of the work roller pair of FIGS. 1A–1C and 4.

FIG. 6 is a pair of schematic side elevation views of a finishing tape magazine engaging a disk being processed in the 9-position station, with FIG. 6A being a full view and FIG. 6B being an enlarged view of the work roller pair 310 of the left-hand finishing tape magazine 302 of FIGS. 1A–1C and 4. FIG. 6A shows, with arrows, the tape feed and take-up paths and direction of motion from the tape supply reels 314*f* (front disk side), 314*r* (rear disk side), around the load rollers 310*f* and 310*r*, to the take-up reels 316*f*, 316*r*, for both the front side tape 306*f* and the back side tape 306*r*. The relation of the load rollers 310 to the disk 14 as mounted on the collet 272*c* of the 9-position station is shown. FIG. 6A, is an enlargement, showing two, back-to-back disks 14*f* and 14*r* being simultaneously processed in the nip between the load rollers 310*f* and 310*r* at the 3-position, with 310*f* processing the front side of disk A, and 310*r* processing the back side of disk B. This is for single side processing.

Figure 7A:
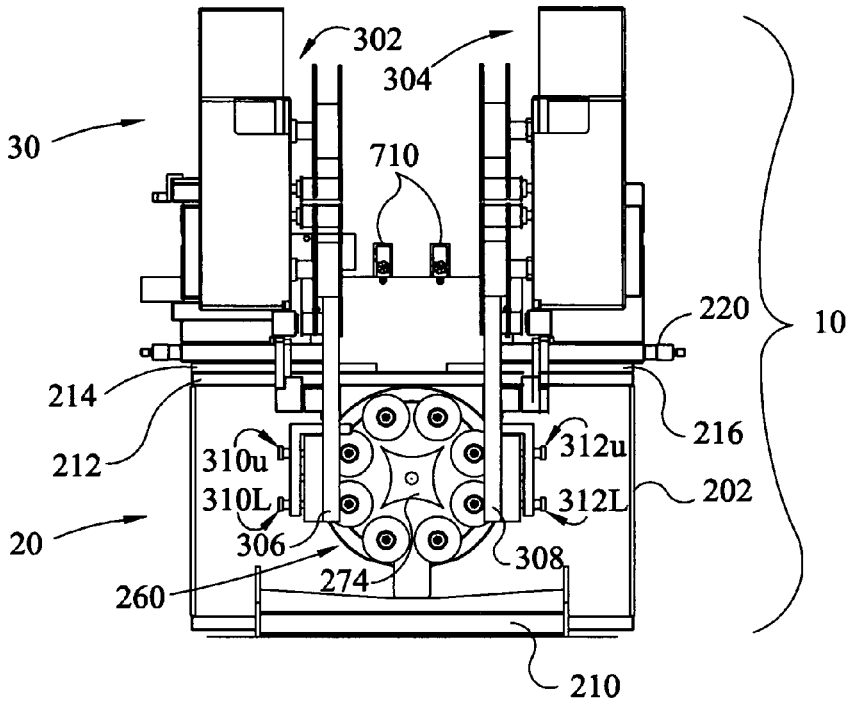
FIG. 7A is a front elevation showing the overall geometry of an 8-spindle turntable with respect to two tape head magazines units each having two pairs of load rollers.

FIG. 7 is a series of three elevation schematic views of a second, 8-up embodiment of the inventive multi-spindle unit 20 integrated with a modified tape finishing unit 30 into the disk finishing system. FIG. 7A is a front elevation of the inventive disk finishing system 10 showing the overall geometry of an 8-spindle turntable 260 with respect to a modified tape finishing unit 30 in which two tape head magazines units 302, 304, each has two pairs of load rollers, an upper pair 310U, 312U, and a lower pair 310L and 312L. As in the 4-up embodiment, the MSU is located in housing 202, and the tape magazines 302, 304 are mounted on their respective adjustable base plates 214, 216.

Figure 7B:
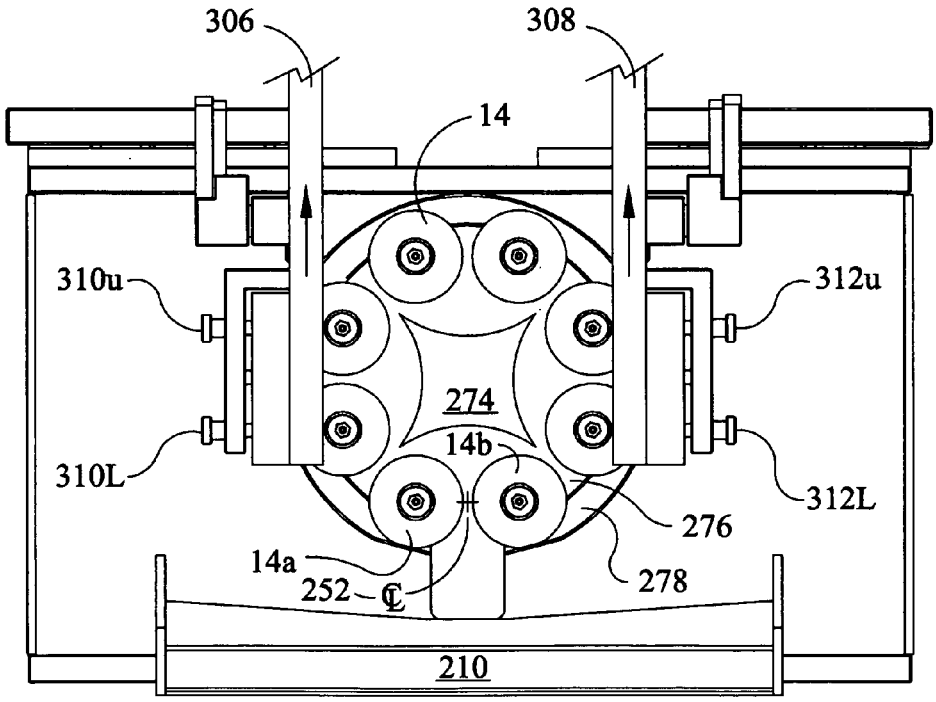
FIG. 7B is an enlargement of the turn-table section of FIG. 7A showing more detail.

FIG. 7B is an enlarged front elevation showing the MSU turntable section of FIG. 7A in more detail. The spray nozzles and vanes of the spray shroud 274 are not shown for clarity. Note the Center Line of the pivoscillation axis 252 is shown centered between the two disks 14*a*, 14*b* at the load/unload station. The handler has corresponding paired, side-by-side grippers that places disks on the corresponding side-by-side collets.

Figure 7C:
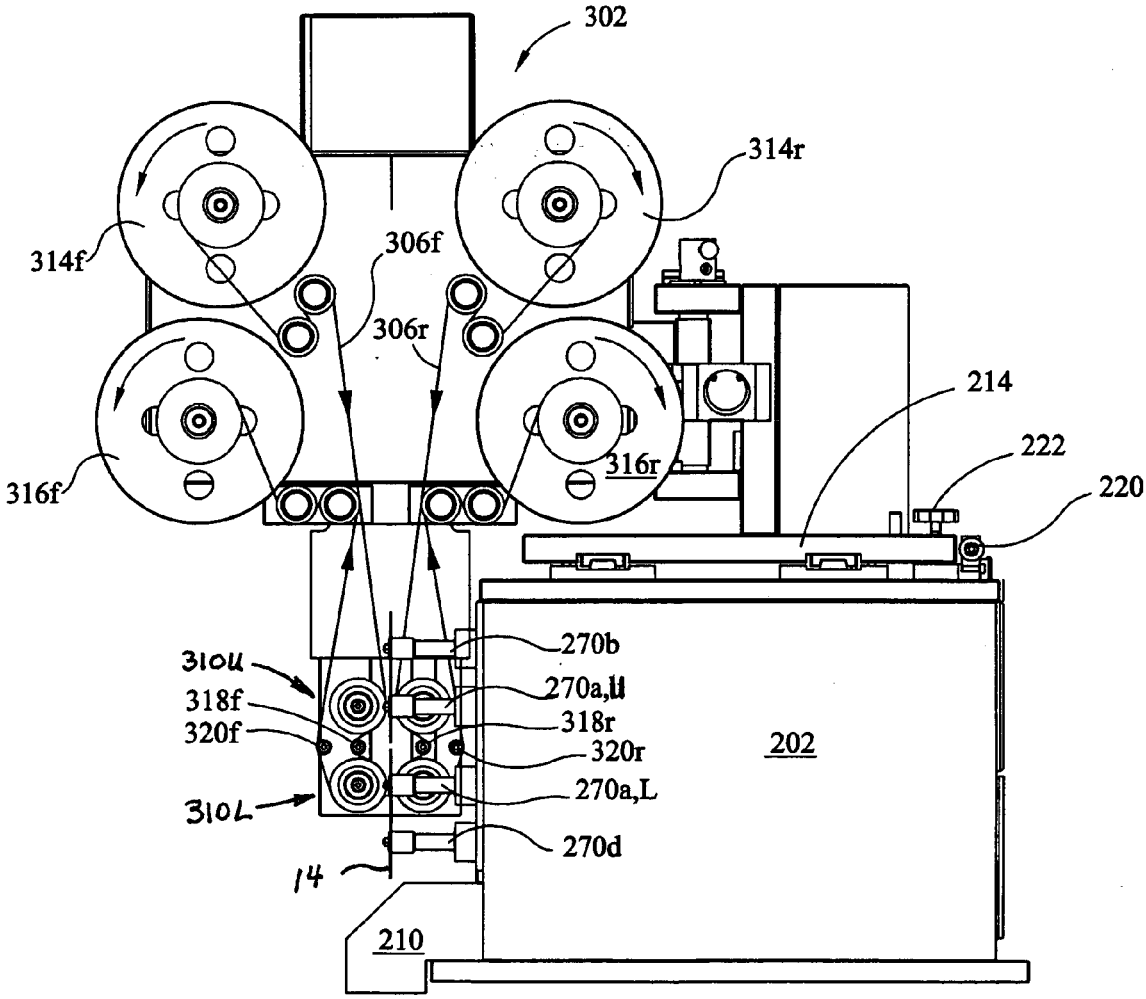
FIG. 7C is a side elevation showing the overall geometry of the tape magazine with the paired upper and lower pinch roller heads finishing the side-by-side, upper and lower disks at the 9 o'clock station position, and a modified tape path.

FIG. 7C is a side elevation of the 8-up system 10 showing the overall geometry of the left tape magazine 302 with the paired upper 310U and lower 310L pinch roller heads finishing side-by-side, upper and lower disks at the 9 o'clock station position, and a modified path of the tape 306. Taking the forward or outboard load rollers first, note that the tape 306*f* serves both the upper and the lower forward pinch rollers 310U and 310L before being rewound onto the rewind reel 316*f*. the path of tape 306 can be followed down from the feed reel 314*f* to the upper forward workload roller 310U, thence over an idler tension roller 318*f*, around the lower work roller 310L, around a front idler 320*f* and then up over the tape drive roller set to be taken up by the take-up reel 316*f*. Conversely, the rear tape is fed from the feed reel 314*r* down around the rear upper work roller 310U, around an idler tension roller 318*r*, thence around the rear lower work roller 310L, over a rear idler roller 320*r*, and then up over the tape drive roller set to be taken up by the take-up rear reel 316*r*. Collet 270*b* is the right collet of the 12-position pair. Collets 270*a*/U and 270*a*/L are the upper and lower 3-position collets, and collet 270*d* is the right collet of the 6-position pair.

The same view would be seen for the 3-position, inverted left/right. The tape skip increments, so that a fresh tape surface is presented simultaneously to the upper and lower disks, and the system controller signal processing and synchronization logic is modified to accommodate the 8-up processing signals traffic.

Figure 8:
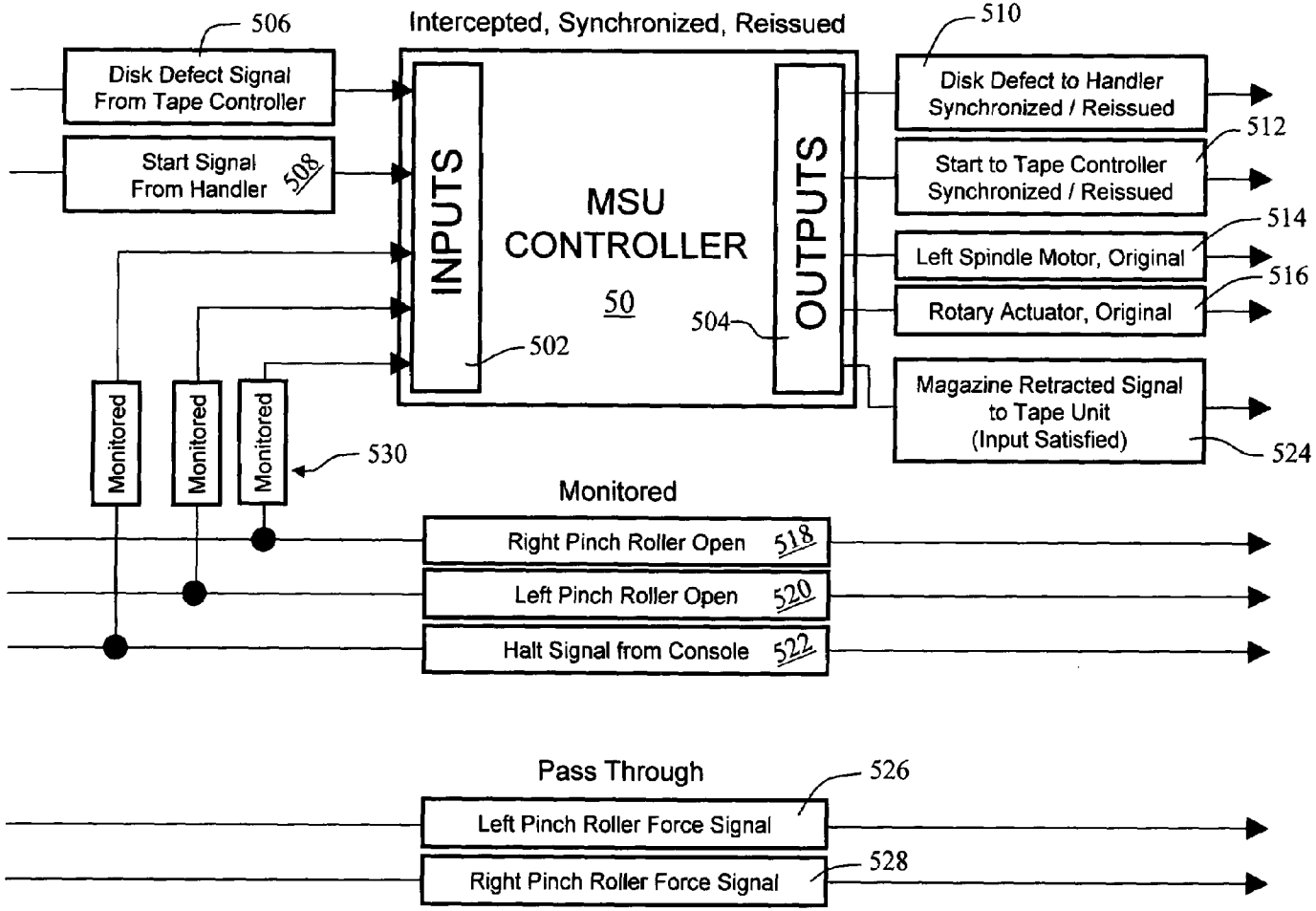
FIG. 8 is a schematic of the inventive disk finishing system controller operation.
Figure 9:
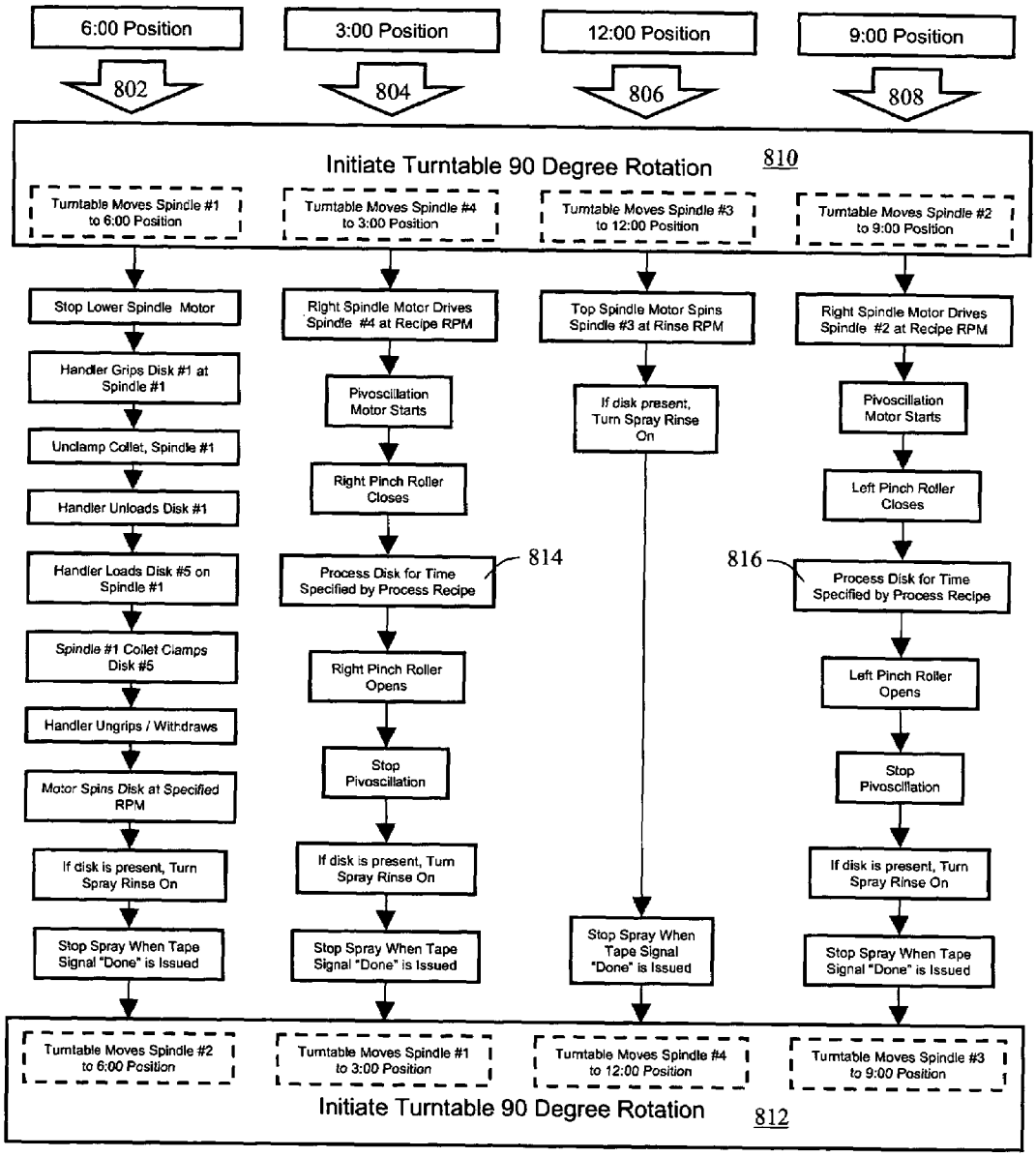
FIG. 9 is a schematic of an exemplary operation of the multi-spindle system, for all spindles in stations between quarter-turns of the turntable, as controlled by the system controller of FIG. 8.

FIG. 8 is a schematic of the inventive disk finishing system control strategy, by which the system controller 50 (see FIG. 1A) synchronously controls the operation of all the sub-assemblies during processing to produce a finished disk in accord with the inventive process steps. This figure should be considered along with the method flow sheet FIG. 9 which shows a schematic of an exemplary operation of the inventive system, by station position, for all spindles in their respective stations between the quarter-turns of the turntable, as controlled by the system controller of FIG. 8. FIG. 8 shows a representative number of examples of the signal processing strategy during start-up, steady state operations and shut-down, while the process of FIG. 9 is exemplary of steady-state operations once all four disks (or 8 disks in the 8-up embodiment) are loaded on respective spindles. In these figures, four parallel events are occurring at once, but at different station positions. Thus, the FIG. 9 flow sheet is arrayed in four columns.

It should be understood that the actuation of the various mechanical, electromechanical and electronic devices of the system is via signals, the example given here being electrical/electronic, although optical, IR, RF magnetic, or kinetic (mechanical, for example) signals may be employed. The inventive disk texturing system controller(s) is/are electronically inserted between the finishing tape unit controller, the turntable and oscillation sub-systems, and the robotic handler to evaluate, monitor, satisfy, sample, or pass through, signals to/from those sub-systems, the various sensors, and the display and operator console.

Referring to FIG. 8, the inventive system 10 includes at least one system controller(s) 50, e.g., a PLC, CPU, PIC, CIU, and the like, that interfaces with the three main electromechanical subsystems via signal inputs 502 and outputs 504 managed through I/O ports: the pivoscillating, indexing turntable with rotating spindles; the tape finishing unit(s), heads and magazines; and the robotic disk handler for load/off-load. Selected signals from the mechanical/electro-mechanical elements/devices of these sub-assemblies are routed or re-routed into the inventive system controller(s) for evaluation, such as a disk defect signal generated by an EDC-finishing tape unit controller 506, or a start signal from the robotic handler 508. The intercepted disk defect signal 506 is intercepted by the controller 50, is then synchronized and reissued or routed 510 to the handler so that the proper disk is removed from the output group as defective. By way of example, the tape unit controller may send a message to the operator console 60 (see FIG. 1B) to display a message on the LCD panel 608, and at the same time trigger an alarm light, such as a yellow or red light 604. For a single spindle processing device, such as the EDC unit, that is a normally immediate message to the operator to discard a mis-processed disk. But if that disk is mis-processed at the 3-position station, actuating a reject command would cause the robot handler to pick a good disk off the 6-position and reject it. Accordingly, the inventive controller can synchronize the arrival of the defective disk at the 6-position by three increments of the turntable, by delaying or reissuing the signal to display that message later when the mis-processed disk is finally moved by the indexing turntable to the load/unload, 6-position.

Similarly a start signal from the handler 508 may be evaluated by the controller 50 and the start signal to the tape unit controller 512 is synchronized and/or reissued as needed to initiate the appropriate action by the tape unit.

Some signals are original to the system controller 50, such as left or right spindle (9- or 3-position) motor ON or OFF, 514, or rotary actuator motor ON or OFF, 516 to index the turret. Still other signals are monitored 530 and serve as inputs to the controller logic to effectuate the process of FIG. 9, such as the right or left pinch (load) roller pairs OPEN or CLOSED, 518, 520, or a STOP or HALT signal 522 from button 610 of the operator console 60 (FIG. 1B). Other signals, such as a signal from the tape unit controller to retract a magazine, upon the signal that the pinch rollers are open 518, 520, are satisfied 524 by the system controller 50. That is, when the tape unit controller signals the magazines to retract, the inventive system controller 50 simply satisfies that signal by answering back with a high condition signal. The magazines do not retract but the tape controller "thinks" they have, having been satisfied by the inventive system controller high condition signal response. Still other signals are passed through to their intended destination, such as the left or right pinch roller force signals from the various sensors of the tape magazines, 526, 528, but may be optionally sampled and archived for process analysis and reports.

Accordingly, by the inventive controller operational logic strategy, the signals from the sub-assemblies are selectively evaluated by the controller, selected from intercepting, monitoring, sampling and reissuing, or are passed through, i.e., remain routed straight to the original tape unit/subsystem controller. Of the evaluated tape and handler elements/devices/signals, some are simply monitored (for high/low condition) and their condition, timing and source are input into the MSU controller(s) as logic inputs, or as history data and/or confirmation of event and the like. Other signals may be delayed, processed, or satisfied, as needed, to synchronize the tape unit operation to the turntable rotation, and/or robotic handler operation. Of course, the system controller issues its own original signals as part of the menu of signals processing involved in the synchronizing of operations of the inventive system.

As illustrated in FIG. 9 the system controller is programmable to initiate (trigger on time and in synchrony) by issuing signals relating to each operational step of the entire system: robotic on-load at 6 position station, including clamp disk (open) of the collet; turntable indexing rotation to 3 position station; spin up of 3-spindle; closing of coarse texture tape head rollers; rotational texturing at 3-station; water supply to 3-station; open 3-station tape head rollers; stop of spindle (if desired); indexing to 12-position; rinse; indexing to 9-position with repeat of texturing steps; index to 6-position with stop of spindle and unclamp (close) of collet for off-load; and all of these steps appropriately timed for the 4 disks continuously in process.

A separate controller in the inventive system (or optionally as an integrated portion of the system controller, called a Communication Interface Unit (CIU), may be used to interface with the communication streams of the tape unit controller or/and the handler controller to manage the error messages and display at the operator console 60. The CIU controller also accepts communication streams coming from a remote computer interface (for troubleshooting and process recipe download). The CIU can interface with the control console of the tape unit. This permits the tape unit console message display to operate seamlessly with the requirements of the system controller 50 for the inventive multi-spindle process. It is also capable of displaying messages generated by the system controller for operation of the inventive multi-spindle Disk Texturing System in the console display and for selecting process steps by use of the keypad 612.

Turning now to FIG. 9 there are four columns, each identifying a unique station position: the load/unload 6-position 802; the $1^{st}$ processing, 3-position 804; the intermediate processing/rinse, 12-position 806; the $2^{nd}$ processing, 9-position 808. The process steps are illustrated at steady state condition, that is where four disks are loaded, one on each spindle, and the steps are identified for the pause of the spindle at each station from an initial turntable indexed quarter-turn rotation 810 to the initiation of a second turntable indexed quarter-turn rotation 812. As in any flow sheet, the boxes are identified and the arrows indicate the operational sequence. Note that the spacing between the horizontal rows of the steps are not the same in columns 802, 804 and 806. This indicates that the timing for each step at each station is different. Although the spacing, and therefore the timing appears the same for column 804 and 808, it should be understood that the time to process the disk at the 3-position station 814 may not be the same as for the disk being processed at the 9-position station 816, as in the case of abrasive or chemo-mechanical texturing, buffing, polishing, wiping, cleaning or the like at those stations may have different dwell periods, as determined by the process recipe. Thus, there may be an idle pause at one or more points in any one or more of the process flows at the stations 802–808. In addition, except for the 6-position load/unload station where the disk is not rotated (or also at the 12-position station if that is also a load/unload station), the spindles need not stop rotating between stations. Thus, when the spindle drive roller leaves contact with the motor traction roller, it can free-wheel or coast, and upon engagement with the traction roller of the next station, it will spin up to speed. This saves time, as the spindle need not go through successive start/stop cycles at each station. The 6-position or other load/unload station may employ a brake to insure spindle rotation is stopped. The brake may be a mechanical, or electro-magnetic (resistance) brake.

INDUSTRIAL APPLICABILITY

It is clear that the inventive disk finishing system and processing methods have wide applicability to the digital media manufacturing industry, particularly to magnetic media type hard drives for a wide range of processes, including disk wiping, polishing, burnishing, cleaning, texturing, lubing and the like, as the inventive system integrates with existing industry equipment and processing infrastructure, and converts one-at-a-time existing tape finishing equipment to virtually continuous operation with very significantly increased throughput without increasing the factory floor footprint size.

It should be understood that various modifications within the scope of this invention can be made by one of ordinary skill in the art without departing from the spirit thereof and without undue experimentation. For example a wide range of wetting agents, cleaning agents or chemical texturing, buffing, polishing, lubing, burnishing and wiping agents can be used, either alone or in combination with abrasive tapes. For example abrasive slurries can be used along with abrasive tapes, or non-abrasive tapes can be used with chemical etchant or abrasive-containing slurries. Likewise, non-abrasive wiping, buffing, polishing or burnishing tapes, alone or in combination with wetting or cleaning solutions can be used in place of the exemplary abrasive texturing tapes disclose in the examples herein. The non-abrasive tapes can be used dry or lubricated. The selection and use of various types of tapes and lubricant, chemical or abrasive slurries or solutions is straight-forward for one skilled in this art. This invention is therefore to be defined by the scope of the appended claims as broadly as the prior art will permit, and in view of the specification if need be, including a full range of current and future equivalents thereof.

APPENDIX A

Parts List - To assist examination; may be canceled upon allowance at option of Examiner.

| | |
|---|---|
| 10 | Disk finishing system |
| 12 | Base cabinet |
| 14 | Disks |
| 20 | Multi-spindle unit (for parts see 200) |
| 30 | Tape finishing unit (for parts see 300) |
| 40 | Robotic handler (for parts see 400) |
| 50 | System controller (for parts see 500) |
| 60 | Operator console (for parts see 600) |
| 70 | Lubricant spray system (for parts see 700) |
| 80 | Processing method (for parts see 800) |
| 202 | MSU housing |
| 204 | Base plate |
| 206 | Side walls |
| 208 | Aperture for turntable assembly |
| 210 | Drip tray |
| 212 | Top plate |
| 214 | Left magazine base plate |
| 216 | Right magazine base plate |
| 218 | Slides |
| 220 | Micrometers |
| 222 | Stops |
| 224 | Scrubbers |
| 226 | Scrubber spindle/drive mechanism |
| 228 | Lateral slide for scrubber at 6-position |
| 230 | Oscillation pivot and drive sub-assembly |
| 232 | Traction drive rollers, a–d |
| 234 | Oscillator sub-assembly |
| 235 | Drive axle |
| 236 | Oscillator cam drive torque tube assembly |
| 237 | Cam |
| 238 | Cam follower assembly |
| 239 | Cam follower roller |
| 240 | Follower pivot shaft |
| 242 | Oscillator arm |
| 244 | Connecting rod |
| 246 | Motor |
| 248 | Belt |
| 250 | Pulley |
| 252 | Pivoscillation axis Center Line (CL) |
| 254 | Approximate CL level of connecting rod pivot |
| 260 | Turntable sub-assembly |
| 262 | Central axle (tube) |
| 263 | Center of rotation of turntable |
| 264 | Turret |
| 270 | Spindles, a–d |
| 271 | Gearing of rotary actuator |
| 272 | Collets, a–d |
| 273 | Collet actuator tube (or rod) |
| 274 | Splash shroud assembly |
| 275 | Vanes |
| 276 | Front splash plate |
| 277 | Collet actuator |
| 278 | Seal plate |
| 279 | Rotary actuator motor |
| 280 | Spindle drive rollers, a–d |
| 281 | Rotary actuator |
| 282 | Pivoting mount sub-assembly |
| 283 | Idler |
| 284 | Base plate w bracket |
| 285 | Bracket |
| 286 | Bearing block |
| 287 | Bearings |
| 288 | Rear pivot block |
| 290 | Turntable mounting plate |
| 291 | Connecting rod pivot |
| 292 | Gusset w pivot link |
| 293 | Belts |
| 294 | Top plate |
| 295 | Belt drive assembly |
| 296 | Motor bracket |
| 297 | Pivot for motor bracket |

APPENDIX A-continued

Parts List - To assist examination; may be canceled upon allowance at option of Examiner.

| | |
|---|---|
| 298 | Spindle motor 3, 9 positions |
| 299 | Spindle motor 12 position |
| 302 | Left tape magazine |
| 304 | Right tape magazine |
| 306 | Left tape |
| 308 | Right tape |
| 310 | Left pair pinch (load) rollers (9-position) |
| 312 | Right pair pinch (load) rollers (3-position) |
| 314f, 314r | Front and Rear disk side tape supply reel |
| 316f, 316r | Front and Rear disk side tape take-up reel |
| 318 f, r | Feed idlers |
| 320 f, r | Take-up idlers |
| 402 | Base cabinet - casette station |
| 404 | Casette |
| 406 | Casette advance (arrow) |
| 408 | Lifter yoke |
| 410 | Disk gripper assembly |
| 412 | Linear transfer mechanism |
| 414 | Disk load/unload (arrow) |
| 416 | Transfer mechanism assembly |
| 418 | Rotation of lifter |
| 420 | Rotation of gripper |
| 502 | Signal inputs |
| 504 | Signal outputs |
| 506 | Disk defects signal from tape controller |
| 508 | Start signal from handler |
| 510 | Disk defect signal to handler |
| 512 | Start signal to tape controller |
| 514 | Spindle motors ON/OFF |
| 516 | Rotary actuator motor ON/OFF |
| 518 | Right pinch (load) roller open |
| 520 | Left pinch (load) roller open |
| 522 | Halt signal from console |
| 524 | Magazine retracted signal |
| 526 | Left pinch force |
| 528 | Right pinch force |
| 530 | Monitored signals |
| 602 | Support bracket for operator I/O panel |
| 604 | Condition alarm light |
| 606 | Alarm light bracket |
| 608 | LCD display |
| 610 | Stop button |
| 612 | Process step selection keypad |
| 702 | Nozzle pairs a–d |
| 704 | Disk front side spray pattern a–d |
| 706 | Disk back side spray a–d |
| 708 | Supply lines |
| 710 | Manifold |
| 802 | 6-position station column |
| 804 | 3-position station column |
| 806 | 12-position station column |
| 808 | 9-position station column |
| 810 | Initial turntable indexed ¼ turn rotation |
| 812 | Next sequential indexed ¼ turn |
| 814 | Process time per recipe, 3-position station |
| 816 | Process time per recipe, 9-position station |

The invention claimed is:

1. A multi-station disk finishing system for digital memory media disks comprising in operative combination:

a) a robotic handler for receiving un-processed disk substrates from an incoming carrier, sequentially loading un-processed disks for finish processing, and unloading processed disks to an outgoing carrier;

b) a multi-spindle disk processor unit, including an array of processing station positions and a plurality of rotationally driven spindles, at least one spindle for each processing station position;

c) said robotic handler sequentially loads onto said spindles each of a plurality of disks for processing at said processing stations, and from which spindles said robotic handler unloads disks to said outgoing carrier after processing;

d) a tape finishing unit, including at least two driven tape magazine assemblies, each magazine assembly being disposed in cooperative alignment with an individual one of said processing stations; and e) a disk processor controller for synchronously sequencing the operation of said robotic handler, said spindles at each station and said tape finishing unit to provide substantially continuous progression of un-processed disks to, from and between all processing stations to a completed, processed disk, and for text messaging to an operator console.

2. A multi-station disk finishing system as in claim 1 wherein at least one of said robotic handler and said disk processor unit are rotationally mounted to provide relative rotational motion between them.

3. A multi-station disk finishing system as in claim 2 wherein said robotic handler includes a plurality of disk gripping assemblies mounted to rotate with respect to said spindle processing station positions to provide said relative rotation to sequentially bring said disks into alignment with said spindles at said stations for loading disks onto, and unloading disks from, said spindles for processing.

4. A multi-station disk finishing system as in claim 2 wherein said robotic handler includes at least one disk gripping assembly and said spindles are mounted on a rotatable turntable assembly to provide said relative rotation to sequentially bring each of said spindles into alignment with said disk gripping assembly for loading disks into, and unloading disks from, said spindle, and for sequentially bringing each loaded spindle into successive station positions for processing.

5. A multi-station disk finishing system as in claim 4 wherein each abrasive tape magazine assembly includes spaced, opposed, openable/closable load rollers defining a nip into which a disk is received for processing on at least one face of said disk and a tape advance drive mechanism, and said tape finishing unit includes at least one controller for processing input/output signals relating to tape operations.

6. A multi-station disk finishing system as in claim 5 wherein said disk processor controller is configurable to monitor at least one of said input/output signals of said tape finishing unit controller selected from intercepting, sampling, delaying and reissuing said signals to assist in synchronizing operation of said multi-station disk processor with operation of said tape finishing unit or said robotic handler.

7. A multi-station disk finishing system as in claim 5 which includes an operator console having at least one input device and a display device, and wherein said disk processor controller is configurable to evaluate at least one input/output signal of said tape finishing unit controller selected from intercepting, monitoring, sampling, delaying and reissuing said signals to assist in synchronizing operation of said multi-station disk processor with operation of said tape finishing unit and said robotic handler.

8. A multi-station disk finishing system as in claim 7 wherein said disk processor controller intercepts at least one signal output from a tape magazine and sends a satisfied signal as an input to said tape finishing unit controller.

9. A multi-station disk finishing system as in claim 7 wherein said disk processor controller intercepts at least one signal output from said tape finishing unit controller and reissues it to said robotic handler.

10. A multi-station disk finishing system as in claim 7 wherein said disk processor controller intercepts at least one signal output from said robotic handler and reissues it to at least one of said multi-spindle unit and said tape finishing unit.

11. A multi-station disk finishing system as in claim 7 wherein said disk processor controller includes a communications interface unit controller for communicating text relating to the operation of said system to said operator console and for forwarding console input and output signals between said disk processor controller and said console.

12. A multi-station disk finishing system as in claim 11 wherein said disk processor controller receives at least one signal output from at least one of a tape magazine, said tape finishing unit controller, said multi-spindle unit, said handler and said console as input to maintain synchronous operation of said system.

13. A multi-station disk finishing system as in claim 4 which includes an oscillation pivot and drive assembly including drive motors for driving a plurality of said spindles when located in said processing station positions.

14. A multi-station disk finishing system as in claim 13 wherein said rotatable turntable assembly is mounted to said oscillation pivot and drive assembly to provide a lateral oscillation of said disks during selected processing operations.

15. A multi-station disk finishing system as in claim 14 wherein said rotatable turntable assembly includes an array of at least four spindles, of which at least three are rotationally driven, said spindles being indexable to processing station positions defined as a 12 o'clock position, a 3 o'clock position, a 6 o'clock position and a 9 o'clock position.

16. A multi-station disk finishing system as in claim 15 wherein at least one of said 12 o'clock and 6 o'clock positions is a load/unload station for receiving un-processed disks from, and delivering processed disks to, said handler.

17. A multi-station disk finishing system as in claim 16 which includes a tape magazine assembly positionable to provide tape to load rollers at each of said 3 o'clock and 9 o'clock positions.

18. A multi-station disk finishing system as in claim 17 wherein both the 12 and 6 o'clock positions are load/unload stations, and said disks are processed in at least one of the 3 and 9 o'clock position stations.

19. A multi-station disk finishing system as in claim 14 wherein said turntable is driven to rotate spindle-mounted disks sequentially, clockwise or counterclockwise, from the 6 o'clock position to the other three positions and back to the 6 o'clock position, and said turntable rotation pauses at each said position for processing of disks at the respective stations of those positions.

20. A multi-station disk finishing systems as in claim 13 wherein said oscillation is centered at the axis of a load/unload station.

21. A multi-station disk finishing system as in claim 20 wherein said oscillation assembly includes a mechanism to oscillate in an amplitude range of from about 0.025" (±0.0125") to about 0.125" (±0.0625") during processing in at least one processing station.

22. A multi-station disk finishing system as in claim 21 wherein at least one of the 12 o'clock and the 6 o'clock position is said load/unload station.

23. A multi-station unit for handling disk substrates in a finishing process and interfacing with a disk tape finishing unit and a robotic handler, comprising in operative combination:

a) a multi-spindle disk handling unit, including an array of processing station positions and a plurality of rotationally driven spindles, at least one spindle for each processing station position;

b) an operator console having at least one input device and a display device;

c) a disk processor controller for synchronously sequencing the operation of said spindles at each station to provide substantially continuous progression of unprocessed disks to, from and between all processing stations to a completed, processed disk, and for text messaging to said operator console.

24. A multi-station unit as in claim 23 wherein said spindles are mounted on a rotatable turntable assembly to provide relative rotation to sequentially bring each of said spindles into alignment with a disk handler assembly for loading disks into, and unloading disks from, said spindle, and for sequentially bringing each loaded spindle into successive station positions for processing.

25. A multi-station unit as in claim 24 which includes an oscillation pivot and drive assembly including drive motors for driving a plurality of said spindles when located in said processing station positions.

26. A multi-station unit as in claim 25 wherein said rotatable turntable assembly is mounted to said oscillation pivot and drive assembly to provide a lateral oscillation of said disks during processing in at least one processing station.

27. A multi-station unit as in claim 26 wherein said turntable is driven to rotate spindle-mounted disks sequentially, clockwise or counterclockwise, from the 6 o'clock position to the other three positions and back to the 6 o'clock position, and said turntable rotation pauses at each said position for processing of disks at the respective stations of those positions.

28. A multi-station unit as in claim 25 wherein said oscillation is centered at the axis of a load/unload station.

29. A multi-station unit as in claim 28 wherein said oscillation assembly includes a mechanism to oscillate in an amplitude range of from about 0.025" (±0.0125") to about 0.125" (±0.0625") during processing in at least one processing station.

30. A multi-station unit as in claim 29 wherein at least one of the 12 o'clock and the 6 o'clock position is said load/unload station.

31. A multi-station unit as in claim 24 wherein said rotatable turntable assembly includes an array of at least four spindles, of which at least three are rotationally driven, said spindles being indexable to processing station positions defined as a 12 o'clock position, a 3 o'clock position, a 6 o'clock position and a 9 o'clock position.

32. A multi-station unit as in claim 31 wherein at least one of said 12 o'clock and 6 o'clock positions is a load/unload station for receiving un-processed disks from, and delivering processed disks to, said robotic handler.

33. A multi-station unit as in claim 32 wherein said disks are processed at each of said 3 o'clock and 9 o'clock positions.

34. A multi-station unit as in claim 32 wherein both the 12 and 6 o'clock positions are load/unload stations, and said disks are processed in at least one of the 3 and 9 o'clock position stations.

35. A multi-station unit as in claim 23 wherein said disk processor controller is configurable to evaluate at least one input/output signal of a controller of said tape finishing unit selected from intercepting, monitoring, sampling, delaying and reissuing said signal to assist in synchronizing operation of said multi-station disk processor with operation of said tape finishing unit and said robotic handler.

36. A multi-station unit as in claim 35 wherein said disk processor controller intercepts at least one signal output from a tape magazine of said tape finishing unit and sends a satisfied signal as an input to said tape finishing unit controller.

37. A multi-station unit as in claim 35 wherein said disk processor controller intercepts at least one signal output from said tape finishing unit controller and reissues it to said robotic handler.

38. A multi-station unit as in claim 35 wherein said disk processor controller intercepts at least one signal output from said robotic handler and reissues it to at least one of said multi-spindle unit and said tape finishing unit.

39. A multi-station unit as in claim 35 wherein said disk processor controller includes a communications interface unit controller for communicating text relating to the operation of said unit to said operator console and for forwarding console input and output signals between said disk processor controller and said console.

40. A multi-station unit as in claim 39 wherein said disk processor controller receives at least one signal output from at least one of a tape magazine of said tape finishing unit, said tape finishing unit controller, said multi-spindle unit, said handler and said console as input to maintain synchronous operation of said system.

41. Method of control of interactive sub-assemblies of memory media disk finishing processing system operations, comprising in operative combination:

a) providing a configurable system controller having at least one digital processor for receiving as input, output signals from at least two electromechanical sub-assemblies, and for out-putting operating signals as input signals to said sub-assemblies, at least one of said sub-assemblies including its own controller and having at least one sensor providing an input signal to its sub-assembly controller;

b) linking said system controller electronically to said sub-assemblies directly or through their own controllers;

c) configuring said system controller to evaluate at least one of said input/output signals of said sub-assemblies controllers or sensors, said evaluation being selected from intercepting, monitoring, sampling, delaying and reissuing said signals;

d) sequencing the operation of said mechanical sub-assemblies by synchronizing in said system controller, input/output signals to provide substantially continuous progression of said disks to, from and between all sub-assemblies to produce a completed processed disk; and e) sending text messages to and receiving input from an operator console relating to said operations.

42. Method of interactive sub-assembly control as in claim 41 wherein at least one of said signals of a sub-assembly is evaluated and said system controller sends a satisfied signal in response to said sub-assembly.

43. Method of interactive sub-assembly control as in claim 42 wherein said satisfied signal is in response to a signal from said tape finishing unit.

44. Method of interactive sub-assembly control as in claim 41 wherein said system controller includes a communications interface unit controller for communicating said text relating to the operation of said system to said operator console and for forwarding console input and output signals between said system controller and said console.

45. Method of interactive sub-assembly control as in claim 44 wherein said sub-assemblies include a tape finishing unit and a multi-spindle unit, and said system controller receives at least one signal output from said tape finishing unit and said console as input to maintain synchronous operation of said system.

46. Method of interactive sub-assembly control as in claim 45 wherein said sub-assemblies include a robotic handler to load and unload disks to and from said multi-spindle unit, and said system controller evaluates at least one signal of said robotic handler to maintain synchronous operation of said system.

47. Method of interactive sub-assembly control as in claim 46 wherein at least one of said robotic handler and said multi-spindle unit are rotationally mounted to provide relative rotational motion between them.

48. Method of interactive sub-assembly control as in claim 47 wherein said robotic handler includes a plurality of disk gripping assemblies mounted to rotate with respect to said multi-spindle unit to provide said relative rotation to sequentially bring said disks into alignment with said spindles at stations for loading disks onto, and unloading disks from, said spindles for processing.

49. Method of interactive sub-assembly control as in claim 47 wherein said robotic handler includes at least one disk gripping assembly and said spindles are mounted on a rotatable turntable assembly to provide said relative rotation to sequentially bring each of said spindles into alignment with said disk gripping assembly for loading disks into, and unloading disks from, said spindle, and for sequentially bringing each loaded spindle into successive positions for processing.

50. Method of finishing digital memory media disk substrates comprising the steps in operative order of:

a) loading at least one unprocessed memory media disk substrate from a group of said disks onto each of a plurality of rotationally driven spindles in an array of processing station positions;

b) contacting at least one side of each disk in at least two selected station positions in said array with a finishing process tape;

c) rotating said disks in said stations by driving said spindles for a time sufficient to provide a preselected amount of finish processing by said tape;

d) unloading processed disks from spindles at said stations when said finish processing is completed at each said station; and e) controlling the operation of said steps of tape finish processing, said loading and said unloading from said spindles to provide substantially continuous synchronous sequential finishing processing of said disks.

51. Method of finishing disks as in claim 50 wherein said steps of loading and unloading are enabled by a robotic handler, and said step of synchronizing includes the operation of said handler to maintain said continuous sequential processing.

52. Method of finishing disks as in claim 51 which includes the step of rotating said spindle array and said robotic handler relative to each other.

53. Method of finishing disks as in claim 52 wherein said step of relative rotation includes rotating a plurality of disk gripping mechanisms of said robotic handler.

54. Method of finishing disks as in claim 52 wherein said step of relative rotation includes sequentially rotating each of said plurality of spindles into successive alignment with a disk gripping mechanism of said robotic handler for said steps of loading said unprocessed disks and unloading said processed disks from said disk gripping mechanism of said robotic handler.

55. Method of finishing disks as in claim 54 which includes an array of four spindles rotatable into station positions of 12 o'clock, 3 o'clock, 6 o'clock and 9 o'clock, and at least one position is a load/unload station and at least two positions are finish processing stations.

56. Method of processing disks as in claim 55 wherein said load/unload station is selected from at least one of 12 o'clock and 6 o'clock.

57. Method of finishing disks as in claim 56 which includes the step of lubricating, cooling or rinsing said disks in at least one of said four stations.

58. Method of finishing disks as in claim 56 which includes rotating spindle-mounted disks sequentially, clockwise or counterclockwise, from the 6 o'clock position to the other three positions and back to the 6 o'clock position, and said rotation pauses at each said position for processing of disks at the respective stations of those positions.

59. Method of finishing disks as in claim 58 which includes the step of laterally oscillating said disks during at least one selected finishing processing step.

60. Method of texturing disks as in claim 59 wherein said oscillation is centered at the axis of a load/unload station.

61. Method of finishing disks as in claim 54 wherein said spindles are mounted on a rotatably driven turntable, and said operation controlling step is enabled by a system controller, said processing step is enabled by a tape finishing unit having a controller, said disk loading/unloading steps are enabled by a robotic handler having a controller, and said controlling step includes providing actuation signals to said turntable and said spindle drives, and interfacing with said tape finishing unit controller, said handler controller and an operator console having an operator input device and a display.

62. Method of finishing disks as in claim 61 wherein said operation controlling step includes:

i) evaluating at least one input/output signal relating to rotation of said spindle turntable and the position of said robotic handler relative thereto, and relating to said tape finish processing, said evaluation being selected from intercepting, monitoring, sampling, delaying and reissuing said signal;

ii) sequencing input/output signals relating to operational steps to provide substantially continuous progression of said disks to, from and between all processing stations to produce a completed processed disk; and iii) sending text messages to and receiving input from said operator console relating to said operations.

63. Method of finishing disks as in claim 62 wherein said evaluating includes sending a satisfied signal in response to an input signal from said controller of said tape finish processing operation.

64. Method of finishing disks as in claim 52 which includes the step of laterally oscillating said disks during at least one selected finishing processing step.

65. Method of finishing disks as in claim 64 wherein said oscillation is centered at the axis of a load/unload station.

66. Method of finishing disks as in claim 52 wherein said step of controlling operational steps includes:

i) evaluating at least one input/output signal relating to relative rotation of said robotic handler and said spindle array, and relating to said tape finishing processing, said evaluation being selected from intercepting, monitoring, sampling, delaying and reissuing said signal;

ii) sequencing input/output signals relating to operational steps to provide substantially continuous progression of said disks to, from and between all processing stations to produce a completed processed disk; and iii) sending text messages to and receiving input from an operator console relating to said operations.

67. Method of finishing disks as in claim 66 wherein said evaluating includes sending a satisfied signal in response to an input signal from a processing operation controller.

68. Method of finishing disks as in claim 67 wherein said satisfied signal is in response to a signal from said tape finish processing operation.

69. Method of finishing disks as in claim 66 wherein said step of controlling includes communicating text relating to said operations to an operator console and for forwarding console input and output signals between a processing operations controller and said console.

70. Method of texturing disks as in claim 52 wherein said controlling step is enabled by a system controller, said finishing step is enabled by a tape finishing unit having a controller, said disk loading/unloading steps are enabled by a robotic handler having a controller, and said controlling step includes interfacing with said tape finishing unit controller, said robotic handler controller and an operator console having an operator input device and a display.

* * * * *